US009892609B2

(12) United States Patent
Kim et al.

(10) Patent No.: US 9,892,609 B2
(45) Date of Patent: Feb. 13, 2018

(54) WEARABLE DEVICE AND METHOD OF PROVIDING INFORMATION BY USING THE WEARABLE DEVICE

(71) Applicant: Samsung Electronics Co., Ltd., Suwon-si, Gyeonggi-do (KR)

(72) Inventors: Jae-hong Kim, Incheon (KR); Jin-hong Min, Suwon-si (KR); Jea-hyuck Lee, Anyang-si (KR); Jae-geol Cho, Yongin-si (KR); Ju-hee Kim, Suwon-si (KR); Jae-hong Kim, Yongin-si (KR); Chang-hyun Kim, Seoul (KR); Kang-jin Yoon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/151,002

(22) Filed: May 10, 2016

(65) Prior Publication Data

US 2016/0335871 A1 Nov. 17, 2016

(30) Foreign Application Priority Data

May 11, 2015 (KR) ..... 10-2015-0065553

(51) Int. Cl.

| | |
|---|---|
| ***G08B 1/08*** | (2006.01) |
| ***G08B 21/02*** | (2006.01) |
| ***G08B 13/181*** | (2006.01) |
| ***G08B 21/04*** | (2006.01) |

(52) U.S. Cl.

CPC ..... *G08B 21/0211* (2013.01); *G08B 13/181* (2013.01); *G08B 21/0283* (2013.01); *G08B 21/0286* (2013.01); *G08B 21/0288* (2013.01); *G08B 21/0294* (2013.01); *G08B 21/0453* (2013.01)

(58) Field of Classification Search

CPC ..... G08B 21/0211; G08B 13/181; G08B 21/0283

USPC ..... 340/539.1, 539.11, 539.13, 573.1

See application file for complete search history.

(56) References Cited

U.S. PATENT DOCUMENTS

| | | | | |
|---|---|---|---|---|
| 7,164,354 | B1 | 1/2007 | Panzer | |
| 7,431,696 | B1 | 10/2008 | Brady et al. | |
| 7,482,935 | B2 | 1/2009 | Lee | |
| 8,140,143 | B2 | 3/2012 | Picard et al. | |
| 8,948,839 | B1 * | 2/2015 | Longinotti-Buitoni | A61B 5/6804 29/825 |
| 2008/0143080 | A1 * | 6/2008 | Burr | D04B 1/14 280/495 |
| 2008/0266118 | A1 | 10/2008 | Pierson et al. | |

(Continued)

FOREIGN PATENT DOCUMENTS

| | | | |
|---|---|---|---|
| KR | 1986-0005556 | B1 | 7/1986 |
| KR | 1990-0003524 | B1 | 3/1990 |

(Continued)

*Primary Examiner* — Daryl Pope

(74) *Attorney, Agent, or Firm* — Jefferson IP Law, LLP

(57) ABSTRACT

A wearable device wearable on a body and a method and an apparatus for providing information by using the wearable device are provided. The wearable device includes at least two sensing units configured to sense detect biometric information of a wearer of the wearable device, and a connector electrically connecting the at least two sensing units to each other and having elasticity.

13 Claims, 40 Drawing Sheets

(56) References Cited

U.S. PATENT DOCUMENTS

| | | | |
|---|---|---|---|
| 2010/0033303 | A1 | 2/2010 | Dugan et al. |
| 2010/0297597 | A1 | 11/2010 | Kim |
| 2014/0125491 | A1 | 5/2014 | Park et al. |
| 2014/0142403 | A1 | 5/2014 | Brumback et al. |
| 2014/0247154 | A1 | 9/2014 | Proud |
| 2015/0018647 | A1 | 1/2015 | Mandel et al. |
| 2015/0065840 | A1 | 3/2015 | Bailey |

FOREIGN PATENT DOCUMENTS

| | | | |
|---|---|---|---|
| KR | 1997-0044006 | A | 7/1997 |
| KR | 1997-0057628 | A | 7/1997 |
| KR | 20-0221787 | Y1 | 2/2001 |
| KR | 2002-0017907 | A | 3/2002 |
| KR | 10-2006-0099991 | A | 9/2006 |
| KR | 10-2006-0105312 | A | 10/2006 |
| KR | 10-0736767 | B1 | 7/2007 |
| KR | 10-0773230 | B1 | 10/2007 |
| KR | 10-0801540 | B1 | 1/2008 |
| KR | 10-2008-0018539 | A | 2/2008 |
| KR | 10-2008-0048598 | A | 6/2008 |
| KR | 10-2008-0096343 | A | 10/2008 |
| KR | 20-2008-0006367 | U | 12/2008 |
| KR | 10-0878038 | B1 | 1/2009 |
| KR | 20-2009-0002818 | U | 3/2009 |
| KR | 10-2011-0073972 | A | 6/2011 |
| KR | 10-2011-0131618 | A | 6/2011 |
| KR | 20-2011-0008266 | U | 8/2011 |
| KR | 10-2012-0062554 | A | 6/2012 |
| KR | 10-1354625 | B1 | 1/2014 |
| KR | 10-2014-0013448 | A | 2/2014 |
| KR | 10-1409500 | B1 | 6/2014 |
| WO | 2008/039082 | A2 | 4/2008 |

* cited by examiner

FIG. 33

| | NORMAL | ABNORMAL |
|---|---|---|
| OXYGEN SATURATION | k >= 95 | k < 95 |
| HEART RATE | 120 <= k <= 140 | k < 120 or k > 140 |
| RESPIRATION RATE PER MINUTE | 30 <= k <= 40 | k < 30 or k > 40 |
| BODY TEMPERATURE | 36.8 <= k <= 37.3 | K < 36.8 or k > 37.3 |

FIG. 34

| NUMBER OF MONTHS | NIGHT SLEEPING HOURS | DAY SLEEPING HOURS | NUMBER OF NAPS | TOTAL SLEEPING HOURS |
|---|---|---|---|---|
| 1 WEEK | 8 HOURS 30 MINUTES | 8시간 | 4 TIMES | 16 HOURS 30 MINUTES |
| 1 MONTH | 8 HOURS 30 MINUTES | 7시간 | 3 TIMES | 15 HOURS 30 MINUTES |
| 3 MONTHS | 10 HOURS | 5시간 | 3 TIMES | 15 HOURS |
| 6 MONTHS | 11 HOURS | 3시간15분 | 2 TIMES | 14 HOURS 15 MINUTES |
| 9 MONTHS | 11 HOURS | 3시간 | 2 TIMES | 14 HOURS |
| 12 MONTHS | 11 HOURS | 2시간15분 | 2 TIMES | 13 HOURS 45 MINUTES |
| 18 MONTHS | 11 HOURS | 2시간30분 | 1 TIME | 13 HOURS 30 MINUTES |
| 24 MONTHS | 11 HOURS | 2시간 | 1 TIME | 13 HOURS |

FIG. 36
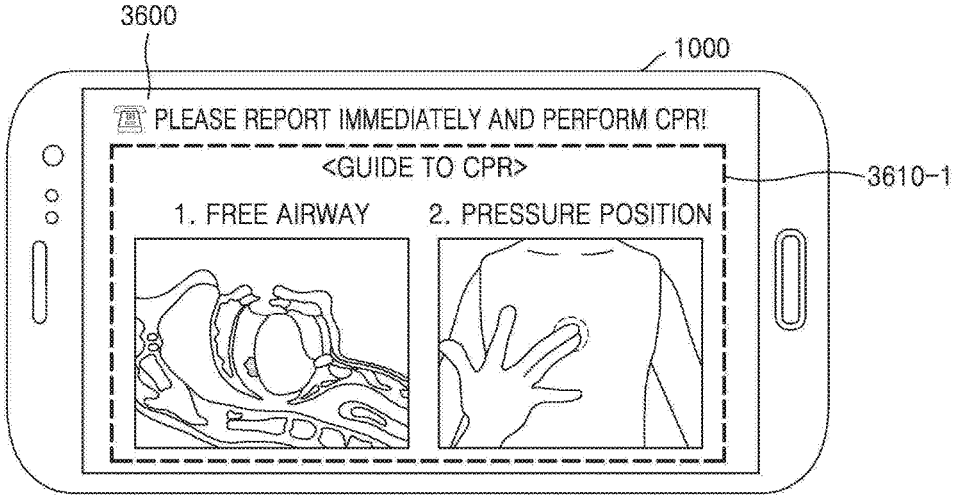
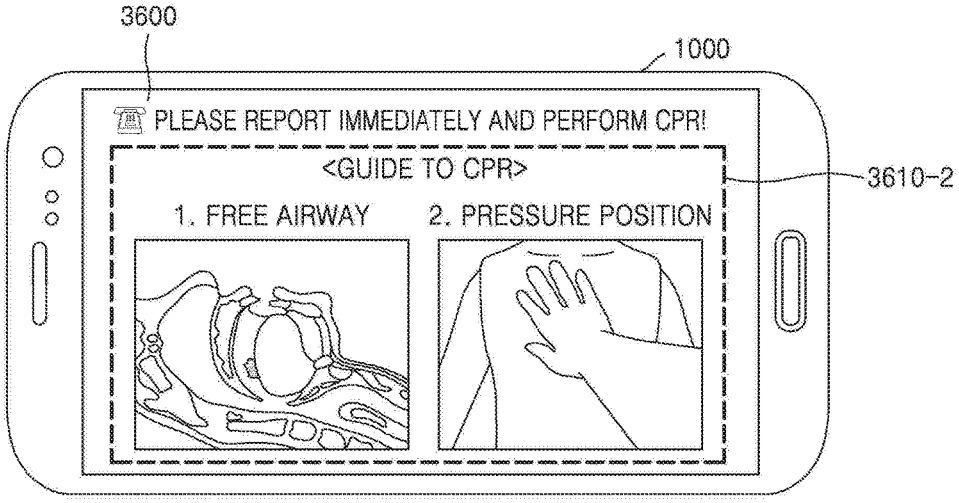

WEARABLE DEVICE AND METHOD OF PROVIDING INFORMATION BY USING THE WEARABLE DEVICE

CROSS-REFERENCE TO RELATED APPLICATION(S)

This application claims the benefit under 35 U.S.C. § 119(a) of a Korean patent application filed on May 11, 2015 in the Korean Intellectual Property Office and assigned Serial number 10-2015-0065553, the entire disclosure of which is hereby

TECHNICAL FIELD

The present disclosure relates to wearable devices that are worn on a user's body and methods of providing information by using the wearable devices. More particularly, the present disclosure relates to a wearable device easily worn on a body of a user and a method of usefully providing information obtained by using the wearable device to the user.

BACKGROUND

Due to to miniaturization and lightening of the weight of electronic devices, wearable devices worn on bodies have been developed. Also, methods of obtaining information related to users wearing the wearable devices by using the wearable devices including various sensors are being studied. Specifically, since an infant cannot suitably express his/her mind or body condition, a condition of the infant may be observed by using the wearable device.

When sensors are applied to the wearable device, it may be difficult for users to wear the wearable device or the sensors may not be placed at suitable locations due to different body sizes or body forms of the users wearing the wearable device. Specifically, since infants grow quickly, a wearable device that may be suitably worn according to physical changes of the infants is required. Also, a method and apparatus for usefully providing information obtained through the wearable device to the user are required.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide wearable devices that may be suitably worn on a user and are capable of obtaining information related to the user. Also, provided are methods and apparatuses for usefully providing information obtained by using the wearable device to the user.

In accordance with an aspect of an aspect of the present disclosure, a wearable device is provided. The wearable device includes at least two sensing units configured to sense detect biometric information of a wearer of the wearable device, and a connector electrically connecting the at least two sensing units to each other and having elasticity.

In accordance with another aspect of the present disclosure, a system is provided. The system includes a wearable device configured to sense biometric information of a wearer by using a sensor, and an electronic apparatus configured to receive the biometric information from the wearable device, determine whether the biometric information is within a normal range, and output, when the biometric information is not within the normal range, output alarm information.

In accordance with another aspect of the present disclosure, a method of processing biometric information of a wearable device is provided. The method includes receiving from at least two sensing units, the biometric information of a wearer of the wearable device, the wearable device having an adjustable length, and transmitting the biometric information to a remote device when the biometric information has at least one value that falls outside a range of known good values for a corresponding sensing unit of the at least two sensing units Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

These and/or other aspects, features, and advantages of certain embodiments of the present disclosure will be more apparent from the following description taken in conjunction with the accompanying drawings in which:

FIG. 33 is a table for describing standards for determining whether sensor information is within a normal range according to an embodiment of the present disclosure;

FIG. 34 is a table for describing examples of suitable sleep patterns according to an embodiment of the present disclosure;

FIG. 36 illustrates feedback output according to various embodiments of the present disclosure.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and the spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As used herein, the term "and/or" includes any and all combinations of one or more of the associated listed items. Expressions such as "at least one of", when preceding a list of elements, modify the entire list of elements and do not modify the individual elements of the list.

In the specification, when a region is "connected" to another region, the regions may not only be "directly connected", but may also be "electrically connected" via another device therebetween. Also, when a region "includes" an element, the region may further include another element instead of excluding the other element, otherwise differently stated.

Reference will now be made in detail to various embodiments, examples of which are illustrated in the accompanying drawings.

Figure 1:
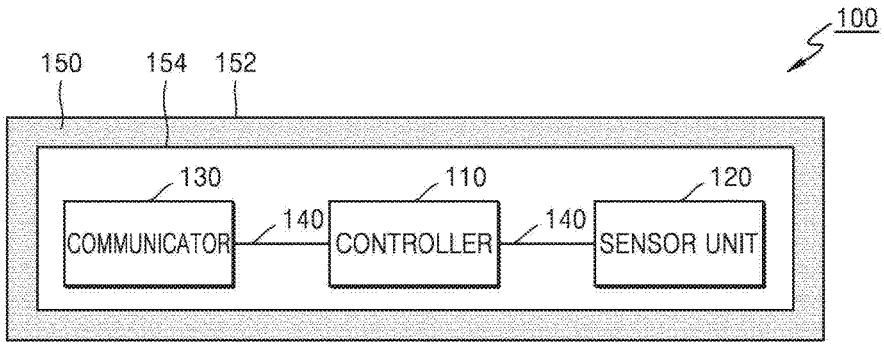
FIG. 1 is a block diagram of a wearable device according to an embodiment of the present disclosure.

FIG. 1 is a block diagram of a wearable device according to an embodiment of the present disclosure.

Referring to FIG. 1, a wearable device 100 may include a controller 110, a sensor unit 120, a communicator 130, a connector 140, and an outer cover 150. The controller 110, the sensor unit 120, the communicator 130, and the connector 140 may be arranged inside the outer cover 150. Also, the wearable device 100 may further include a power supplier (not shown) supplying power to components of the wearable device 100. The power supplier may supply power to the components, such as the controller 110, the sensor unit 120, and the communicator 130, from a chargeable battery or another power source.

The sensor unit 120 may obtain information for measuring a target by using at least one sensor. For example, the sensor may generate a constant signal by detecting or distinguishing, and measuring a physical amount of heat, light, a temperature, pressure, or sound, or a chemical material. In other words, the sensor may obtain information related to at least one of the wearable device 100 and a user (i.e., a wearer) of the wearable device 100. Examples of the sensor include a temperature sensor, a humidity sensor, an acceleration sensor, and an optical sensor, but are not limited thereto. The temperature sensor is a sensor for measuring an atmospheric temperature or a body temperature of a person. The humidity sensor is a sensor for electrically detecting humidity by using properties in which a resistance value or dielectric constant of an organic polymer or ceramic changes due to vapor in the air. The optical sensor is a sensor for detecting light. The sensor unit 120 or the controller 110 may obtain biometric information of the wearer based on light detected by using the optical sensor. The biometric information may include, for example, information about oxygen saturation, pulse, and respiration. According to an embodiment, the sensor included in the sensor unit 120 may be placed outside the outer cover 150 to detect information. The outside of the outer cover 150 may include at least one of an outer surface 152 and an inner surface 154.

The communicator 130 may transmit information detected by the sensor unit 120 to an external apparatus. For example, the communicator 130 may transmit information about a temperature or oxygen saturation to the external apparatus via a short-distance wireless communication. Examples of the external apparatus include a smart phone, another wearable device, a tablet personal computer (PC), a desktop computer, a laptop computer, a connected television (TV), an Internet of things (IoT) hub, and a server (e.g., a cloud server).

The controller 110 may control the sensor unit 120 and the communicator 130, and process various types of information. For example, the controller 110 may include a microcontroller unit (MCU). The controller 110 may include a storage apparatus in which a control program for controlling the wearable device 100, or an external signal or data is stored. Also, the controller 110 may include a processor for processing data.

According to an embodiment, the controller 110 may control power supplied to the wearable device 100. For example, when the sensor unit 120 includes an acceleration sensor, the controller 110 may determine whether the wearable device 100 is being used based on information obtained through the acceleration sensor. When it is determined that the wearable device 100 is not being used, the controller 110 may control power supplied to each component of the wearable device 100 such that some functions of the wearable device 100 are suspended.

The connector 140 may electrically connect the components of the wearable device 100. Since the wearable device 100 is worn on a body of the wearer, the connector 140 needs to be flexible. For example, the connector 140 may be a flexible printed circuit board (FPCB).

The outer cover 150 may be formed of a material whose shape is changeable in order to protect the sensor unit 120, the communicator 130, and the controller 110, and to enable the wearable device 100 to be worn on the body of the wearer. For example, the outer cover 150 may be formed of a stretchable material, such as rubber, silicon, or urethane.

Figure 2:
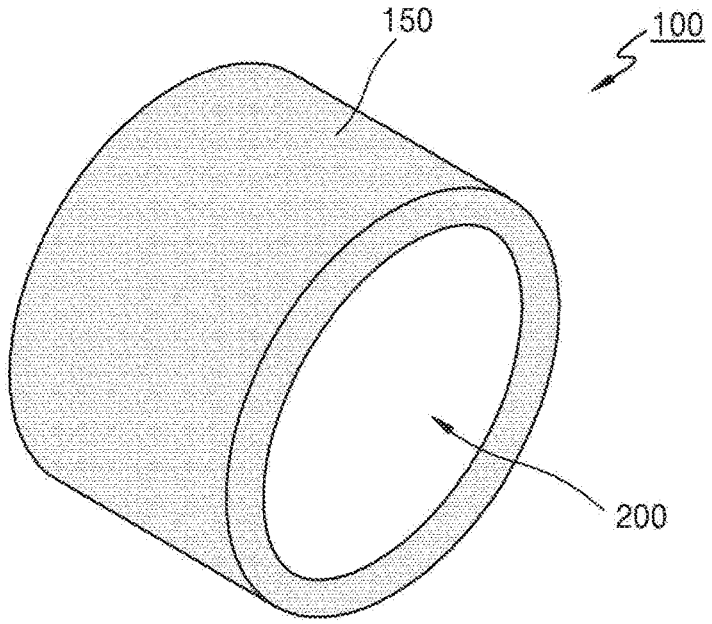
FIG. 2 is a perspective view of an external shape of a wearable device according to an embodiment of the present disclosure.

FIG. 2 is a perspective view of an external shape of a wearable device according to an embodiment of the present disclosure.

Referring to FIG. 2, the outer cover 150 of the wearable device 100 according to an embodiment may have a ring shape. The outer cover 150 having the ring shape may accommodate the body of the wearer in a center cavity 200. The body of the wearer denotes a part of the body for wearing the wearable device 100. For example, the body may be a wrist, an ankle, a forehead, or a chest. In the present specification, a size of the body may denote a circumference or a diameter of the part of the body on which the wearable device 100 is worn. The size of the body may vary according to the wearer or according to an age of the wearer. Specifically, if the wearer is an infant who grows fast, the size of the body may vary according to the age of the wearer.

Figure 3A:
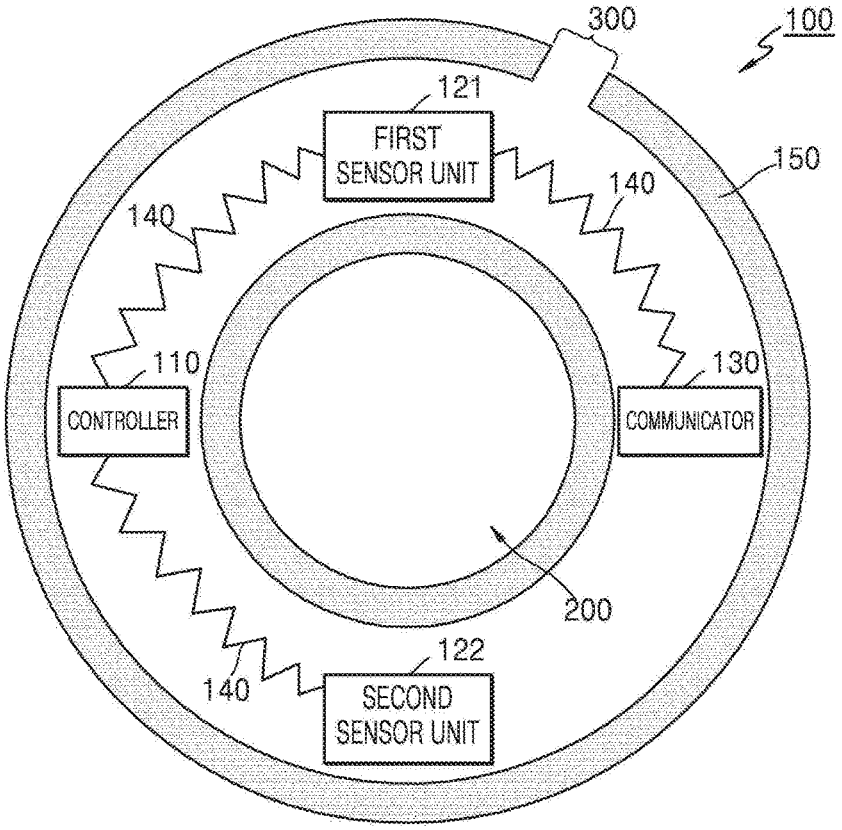
FIGS. 3A to 3C are diagrams for describing a structure of a wearable device according to an embodiment of the present disclosure.
Figure 3B:
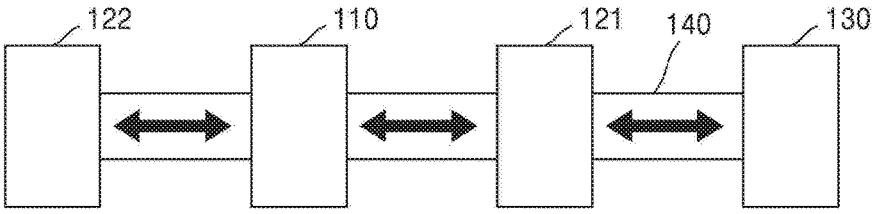
Figure 3C:
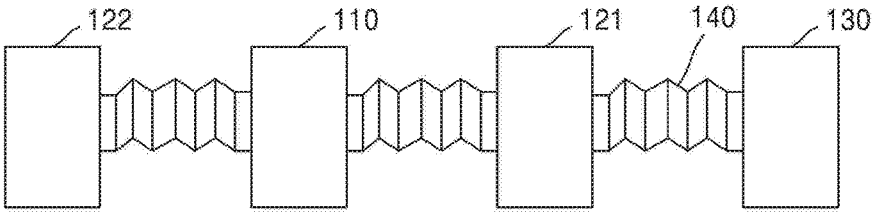

FIGS. 3A to 3C are diagrams for describing a structure of a wearable device according to an embodiment of the present disclosure.

Referring to FIG. 3A, a sensor unit, the communicator 130, the controller 110, and the connector 140 may be provided in the outer cover 150 having the ring shape. The sensor unit may include a first sensor unit 121 and a second sensor unit 122. The body of the wearer may be accommodated in the center cavity 200 of the outer cover 150 having the ring shape. Also, in order to prevent a temperature of the wearable device 100 from increasing due to heat generated by the components (the first sensor unit 121, the second sensor unit 122, the communicator 130, the controller 110, and the connector 140) provided in the outer cover 150, at least one hole 300 through which air passes may be formed on an outer surface of the outer cover 150.

Referring to FIGS. 3B and 3C, a length of the connector 140 may be stretchable in order to connect the components (the first sensor unit 121, the second sensor unit 122, the communicator 130, the controller 110, and the connector 140) even when the outer cover 150 stretches. For example, referring to FIG. 3B, the connector 140 may include a stretchable PCB. The stretchable PCB may be configured by using not only a wire formed of metal, but also a wire formed of a conductive stretchable material. For example, the stretchable PCB may be formed by using not only wrinkled copper formed on urethane, but also a conductive material, such as conductive polymer, carbon nanotube, or graphene. As another example, referring to FIG. 3C, the connector 140 may include FPCB having a wrinkled shape. When the outer cover 150 extends due to the body of the wearer, or the like, wrinkles of the connector 140 may spread, and the connector 140 may extend as much as an increased length of the outer cover 150.

Figure 4A:
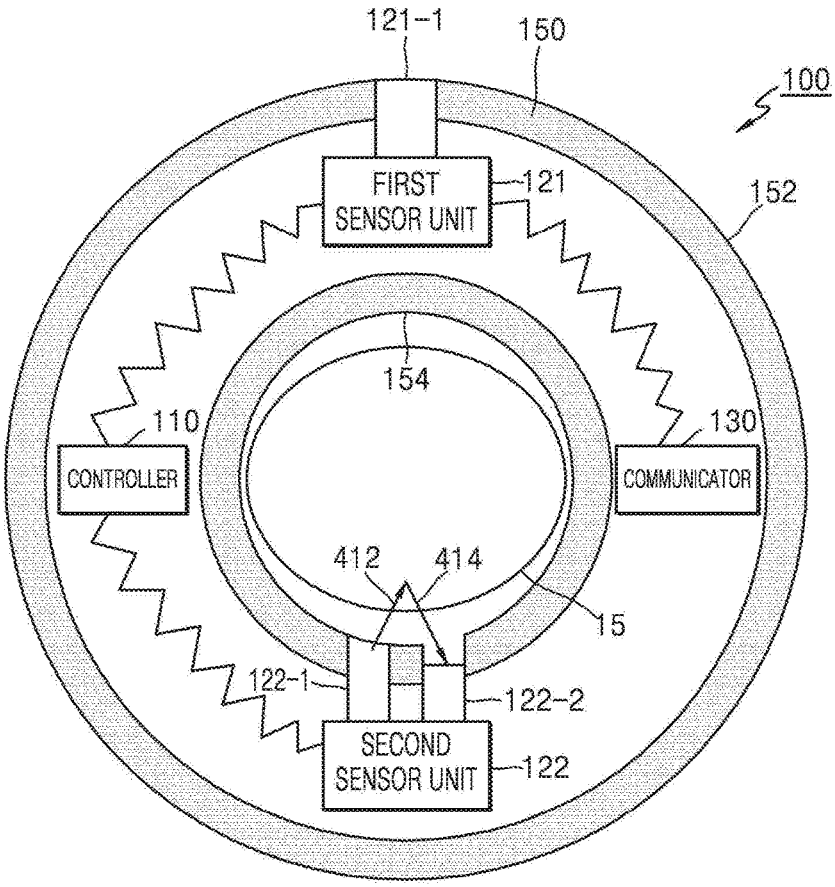
FIGS. 4A to 4C are diagrams for describing a structure of a wearable device according to another embodiment of the present disclosure.
Figure 4B:
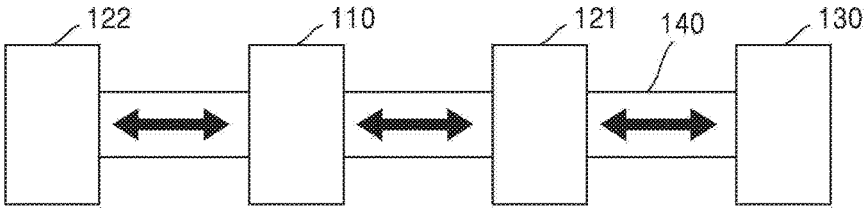
Figure 4C:
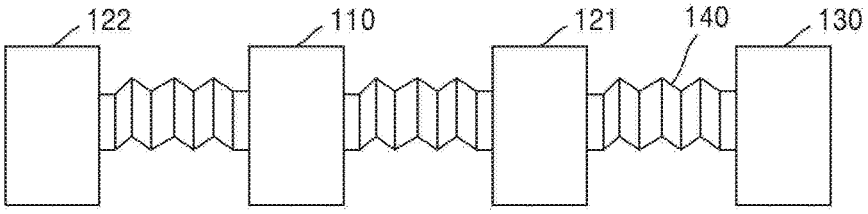

FIGS. 4A to 4C are diagrams for describing a structure of a wearable device according to another embodiment of the present disclosure. Specifically, the wearable device 100 of FIGS. 4A to 4C includes a reflective oxygen saturation detector using an optical sensor.

Referring to FIG. 4A, the first sensor unit 121 may include a temperature sensor 121-1 for detecting a temperature around the wearable device 100. The temperature sensor 121-1 may be a temperature/humidity sensor for detecting not only a temperature but also humidity. Also, the second sensor unit 122 may include an optical sensor. The optical sensor may include an emitter 122-1 emitting an optical signal 412 and an optical receiver 122-2 receiving an optical signal 414. The emitter 122-1 may include a laser diode (LD) for generating the optical signal 412. The optical receiver 122-2 may include a photodiode (PD) that receives the optical signal 414 reflected from a body 15 of a wearer and converts the optical signal 414 to an electric signal. Also, the second sensor unit 122 may further include a body temperature sensor 121-3 for detecting a body temperature of the wearer.

For example, when the wearable device 100 is worn on an ankle of the wearer, the first sensor unit 121 may be provided at the front of the ankle. Also, the second sensor unit 122 may be provided at the back of the ankle, which is opposite to where the first sensor unit 121 is provided.

In order to detect an external atmospheric temperature and/or humidity, the temperature sensor 121-1 may be externally exposed through the outer surface 152 of the outer cover 150. Also, the temperature sensor 121-1 may further include a humidity sensor for detecting external humidity. Also, in order to measure the oxygen saturation of the body 15, the emitter 122-1 and the optical receiver 122-2 may be externally exposed through the inner surface 154 of the outer cover 150. The optical signal 412 emitted from the emitter 122-1 is reflected at the body 15 of the wearer wearing the wearable device 100. A light absorption coefficient varies according to a ratio of oxyhemoglobin (HbO2) and reduced hemoglobin (Hb) in blood of the wearer. In other words, a wavelength of reflected light changes according to the ratio of HbO2 and Hb. The optical receiver 122-2 may convert the optical signal 414 into an electric signal. The second sensor unit 122 or the controller 110 may determine the oxygen saturation based on the electric signal received from the optical receiver 122-2. Also, the second sensor unit 122 or the controller 110 may obtain information about pulse or respiration of the wearer based on the electric signal received from the optical receiver 122-2.

The controller 110 may control the communicator 130 to transmit the temperature and the oxygen saturation determined by the first and second sensor units 121 and 122 to another device.

Referring to FIGS. 4B and 4C, the length of the connector 140 may be configured to be stretchable in order to connect the components (the first sensor unit 121, the second sensor unit 122, the communicator 130, the controller 110, and the connector 140) even when the outer cover 150 stretches. For example, referring to FIG. 4B, the connector 140 may include a stretchable PCB. The stretchable PCB may be configured by using not only a wire formed of a metal, but also a wire formed of a conductive stretchable material. For example, the stretchable PCB may be configured by using not only wrinkled copper formed on urethane, but also by using a conductive material, such as conductive polymer, carbon nanotube, or graphene. As another example, referring to FIG. 4C, the connector 140 may include a wrinkled FPCB. When the outer cover 150 extends due to the body 15 of the wearer, wrinkles of the connector 140 may spread and thus the connector 140 may stretch as long as an increased length of the outer cover 150.

Figure 5A:
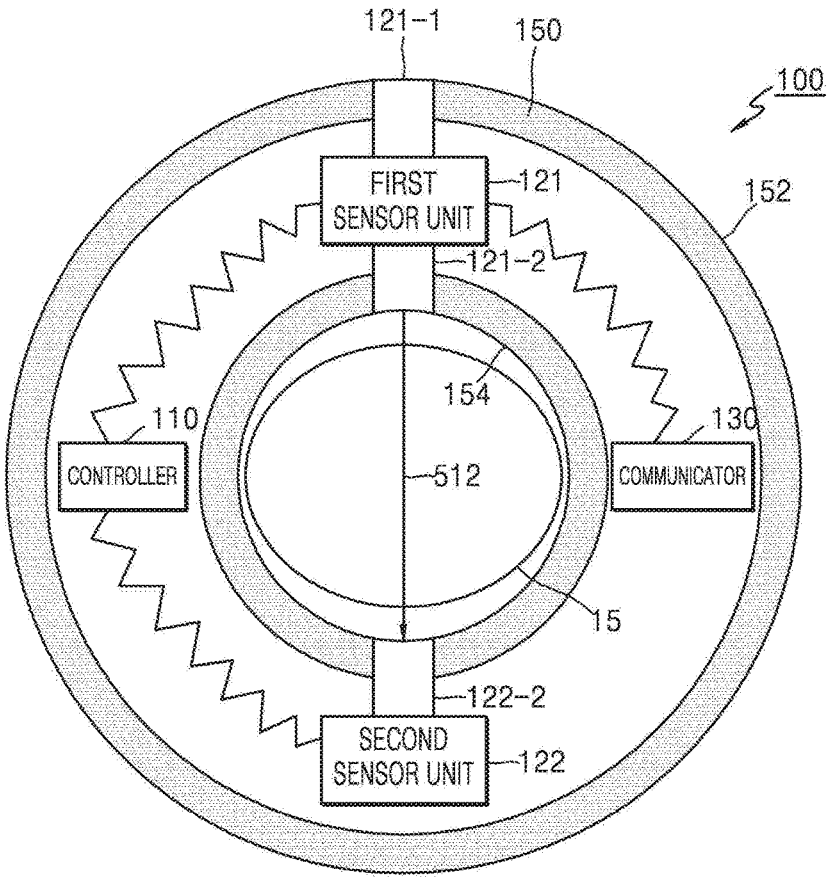
FIGS. 5A to 5C are diagrams for describing a structure of a wearable device according to another embodiment of the present disclosure.
Figure 5B:
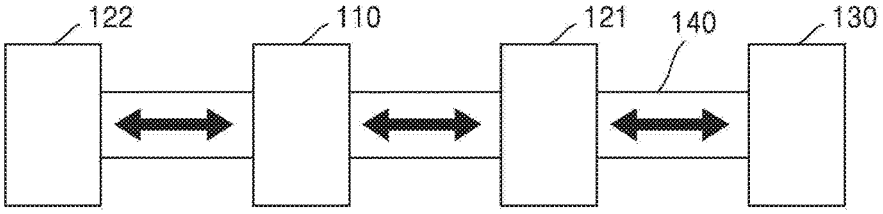
Figure 5C:
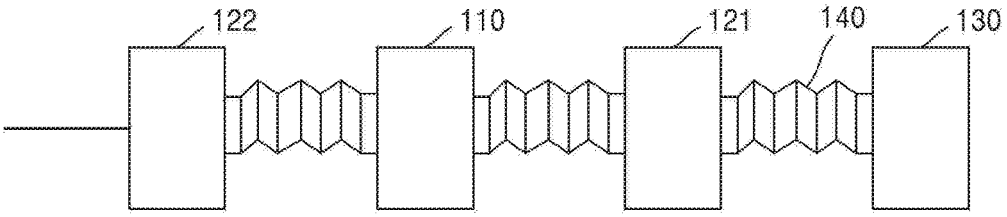

FIGS. 5A to 5C are diagrams for describing a structure of a wearable device according to another embodiment of the present disclosure.

Referring to FIG. 5A, like the wearable device 100 of FIG. 4A, the wearable device 100 of FIG. 5A may include the controller 110, the first sensor unit 121, the second sensor unit 122, and the communicator 130. The first sensor unit 121 may include the temperature sensor 121-1 exposed at the outer surface 152 and an emitter 121-2 including an LD exposed at the inner surface 154. Also, the second sensor unit 122 may include the optical receiver 122-2 including a PD exposed at the inner surface 154. In other words, the emitter 121-2 and the optical receiver 122-2 may face each other, wherein the body 15 is provided therebetween. In this case, light 512 emitted from the emitter 121-2 may pass through the body 15 and transmitted to the optical receiver 122-2. By measuring oxygen saturation by using the light 512 that passed through the body 15, the oxygen saturation may be accurately obtained. Also, the second sensor unit 122 or the controller 110 may obtain information about pulse or respiration of the wearer based on an optical signal detected through the optical receiver 122-2.

The optical receiver 122-2 may be provided on the inner surface 154, and may be provided opposite to the emitter 121-2. For example, when the body 15 on which the wearable device 100 is worn is an ankle, the emitter 121-2 may be located in front of the ankle and the optical receiver 122-2 may be located at the back of the ankle. However, an arrangement of the emitter 121-2 and the optical receiver 122-2 is not limited thereto.

Figure 6A:
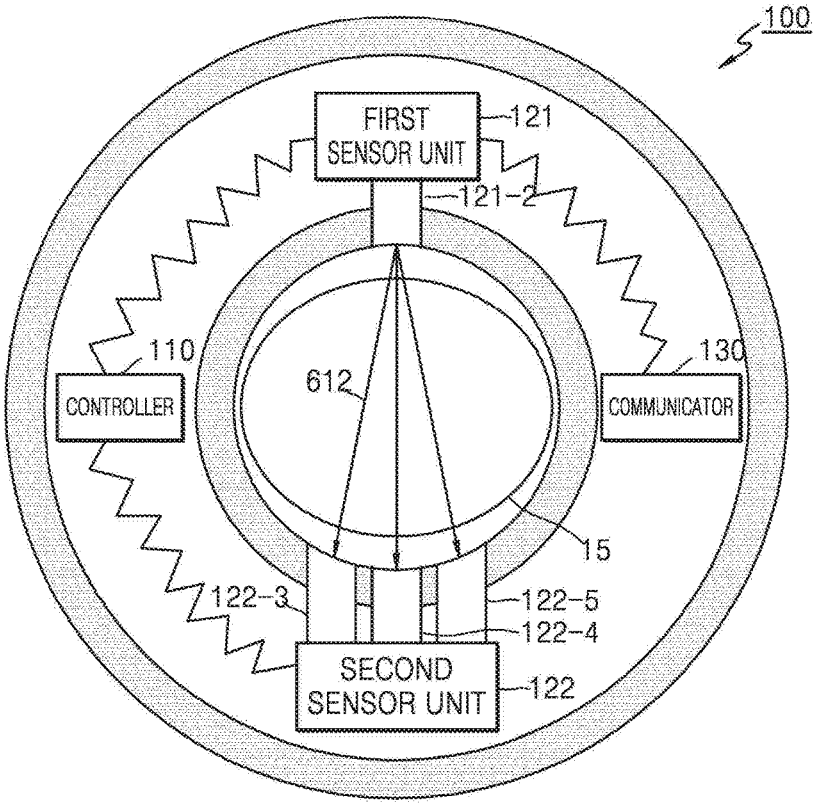
FIGS. 6A to 6C are diagrams for describing a structure of a wearable device according to another embodiment.
Figure 6B:
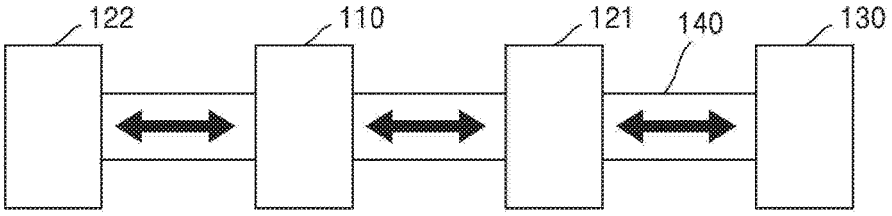
Figure 6C:
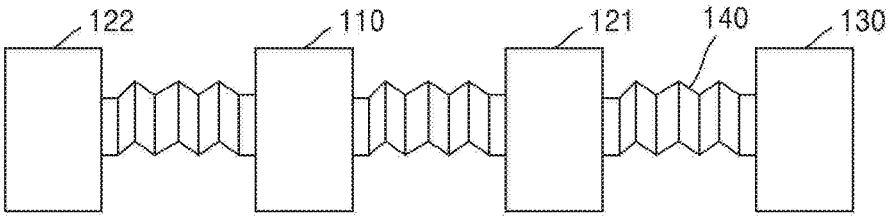

According to an embodiment, in order to obtain accurate information, the optical receiver 122-2 of the wearable device 100 may include a plurality of PDs 122-3 through 122-5 as shown in FIGS. 6A to 6C.

Referring to FIGS. 5B and 5C, the length of the connector 140 may be configured to be stretchable in order to connect the components (the first sensor unit 121, the second sensor unit 122, the communicator 130, the controller 110, and the connector 140) even when the outer cover 150 stretches. For example, referring to FIG. 5B, the connector 140 may include a stretchable PCB. The stretchable PCB may be configured by using not only a wire formed of a metal, but also a wire formed of a conductive stretchable material. For example, the stretchable PCB may be configured by using not only wrinkled copper formed on urethane, but also by using a conductive material, such as conductive polymer, carbon nanotube, or graphene. As another example, referring to FIG. 5C, the connector 140 may include a wrinkled FPCB. When the outer cover 150 extends due to the body 15 of the wearer, wrinkles of the connector 140 may spread and thus the connector 140 may stretch as long as an increased length of the outer cover 150.

FIGS. 6A to 6C are diagrams for describing a structure of a wearable device according to another embodiment of the present disclosure.

Referring to FIG. 6A, the optical receiver 122-2 of the wearable device 100 may include the plurality of PDs 122-3 through 122-5. The PDs 122-3 through 122-5 may each receive light 612 that is emitted from the emitter 121-2 and penetrated through the body 15 of the wearer. The controller 110 or the second sensor unit 122 may select a PD that received a most satisfactory optical signal from among the PDs 122-3 through 122-5. The most satisfactory optical signal may denote a signal having a greatest strength from among received signals. However, an embodiment is not limited thereto, and when the strength of an optical signal is equal to or higher than a certain threshold value, that is, when the strength of the optical signal is too great, the optical signal may have an error by an effect of an external light source, and so, a PD that receives another optical signal may be selected. The controller 110 or the second sensor unit 122 may deactivate the PDs 122-3 through 122-5 excluding the selected PD. The second sensor unit 122 may measure oxygen saturation by using the selected PD.

Referring to FIGS. 6B and 6C, the length of the connector 140 may be configured to be stretchable in order to connect the components (the first sensor unit 121, the second sensor unit 122, the communicator 130, the controller 110, and the connector 140) even when the outer cover 150 stretches. For example, referring to FIG. 6B, the connector 140 may include a stretchable PCB. The stretchable PCB may be configured by using not only a wire formed of a metal, but also a wire formed of a conductive stretchable material. For example, the stretchable PCB may be configured by using not only wrinkled copper formed on urethane, but also by using a conductive material, such as conductive polymer, carbon nanotube, or graphene. As another example, referring to FIG. 6C, the connector 140 may include a wrinkled FPCB. When the outer cover 150 extends due to the body 15 of the wearer, wrinkles of the connector 140 may spread and thus the connector 140 may stretch as long as an increased length of the outer cover 150.

Figure 7:
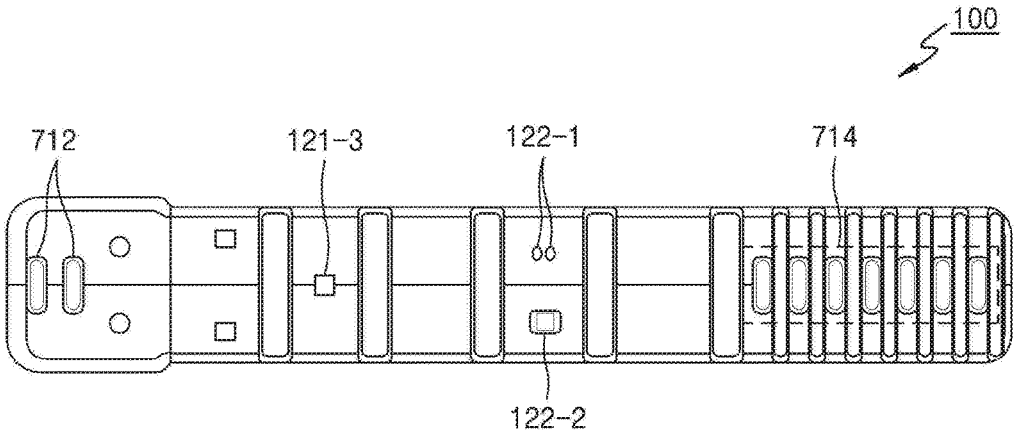
FIG. 7 is a plan view of a structure of a wearable device according to an embodiment of the present disclosure.

FIG. 7 is a plan view of a structure of a wearable device according to an embodiment of the present disclosure.

Referring to FIG. 7, the wearable device 100 may have a band shape. The wearable device 100 may be worn on a body of a wearer by including a fastening portion at two ends of an outer cover. The fastening portion may include a protruding portion 712 and an accommodating portion 714. One end of the outer cover of the wearable device 100 may include the protruding portion 712 and the other end of the outer cover may include a plurality of the accommodating portions 714 that accommodate and are fastened to the protruding portion 712. However, an embodiment is not limited thereto, and a structure of the fastening portion may vary.

Also, the body temperature sensor 121-3 for measuring a body temperature of the wearer, and the emitter 122-1 and the optical receiver 122-2 for measuring oxygen saturation, pulse, and respiration of the wearer may be exposed on one surface of the wearable device 100. The optical receiver 122-2 may be disposed near the emitter 122-1 in order to receive light emitted from the emitter 122-1 and reflected from the body of the wearer.

Figure 8:
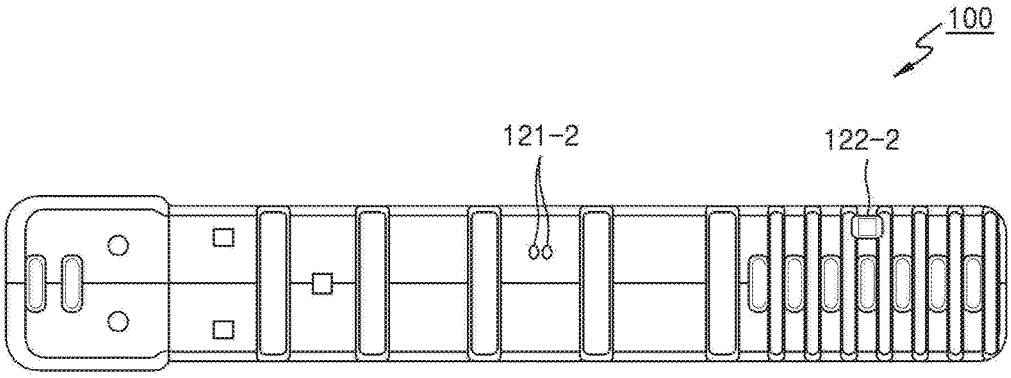
FIG. 8 is a plan view of a structure of a wearable device according to another embodiment of the present disclosure.

FIG. 8 is a plan view of a structure of a wearable device according to another embodiment of the present disclosure.

Referring to FIG. 8, the emitter 121-2 may be located away from the optical receiver 122-2 such that the emitter 121-2 and the optical receiver 122-2 are located on opposite sides to each other with respect to a body of a wearer when the wearer wears the wearable device 100. However, at this time, a location of the optical receiver 122-2 may not be suitable to receive light emitted from the emitter 121-2 based on a size or part of the body of the wearer. For example, the emitter 121-2 and the optical receiver 122-2 may face each other when the wearable device 100 is worn on an ankle of the wearer, the ankle having a width diameter of 3 cm. However, when the wearable device 100 is worn on an ankle having a width diameter of 5 cm, relative locations of the optical receiver 122-2 and the emitter 121-2 may change and the optical receiver 122-2 and the emitter 121-2 may not be aligned to face each other. Accordingly, the wearable device 100 may include a connector (e.g., the connector 140 of FIG. 6B or 6C) that electrically connects the emitter 121-2 and the optical receiver 122-2 and has a variable length. Alternatively, the optical receiver 122-2 of the wearable device 100 according to an embodiment may include a plurality of PDs to obtain accurate biometric information.

Figure 9:
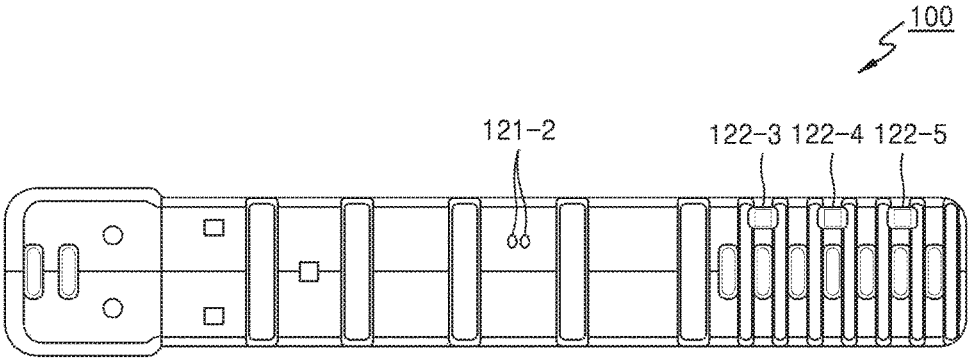
FIG. 9 is a plan view of a structure of a wearable device according to another embodiment of the present disclosure.

FIG. 9 is a plan view of a structure of a wearable device according to another embodiment of the present disclosure.

Referring to FIG. 9, the wearable device 100 may include the plurality of PDs 122-3 through 122-5 that are spaced apart from the emitter 121-2.

Figure 10:
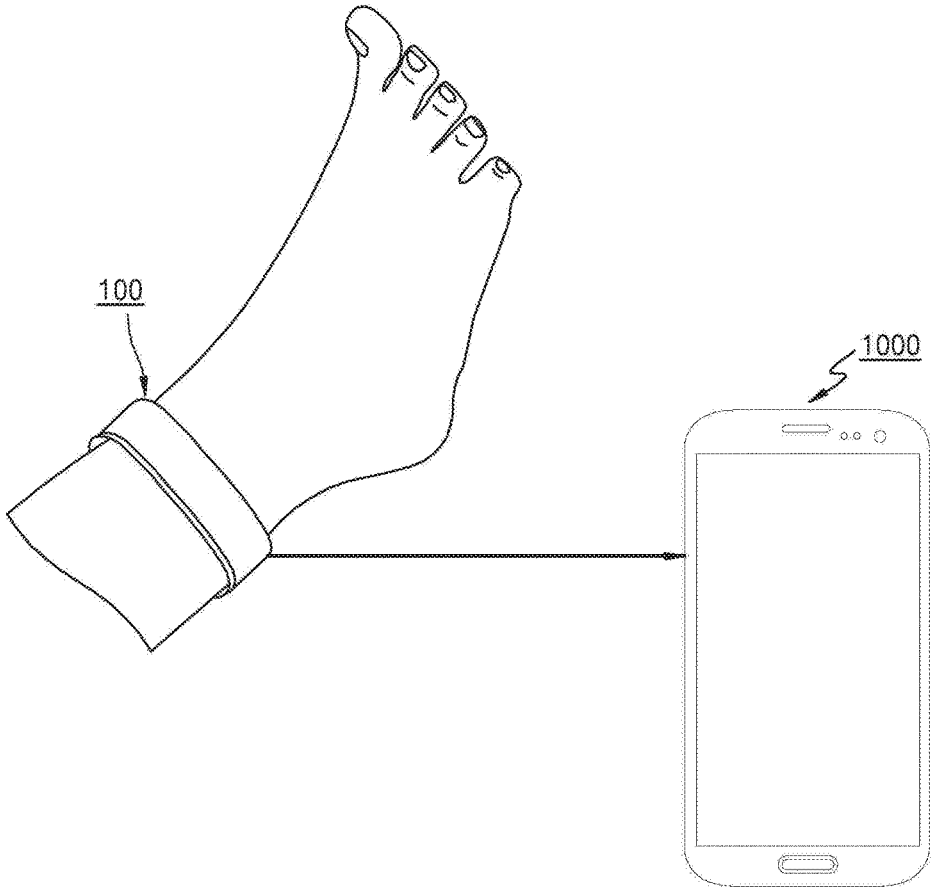
FIG. 10 is a conceptual diagram of a system for providing information according to an embodiment of the present disclosure.

FIG. 10 is a conceptual diagram of a system for providing information according to an embodiment of the present disclosure.

Referring to FIG. 10, the wearable device 100 may be worn on a body (e.g., a wrist or an ankle) of a wearer. The wearable device 100 worn on the body may obtain biometric information of the wearer or environment information of the wearer. The wearable device 100 may transmit obtained information to an electronic apparatus 1000.

Upon receiving the information from the wearable device 100, the electronic apparatus 1000 may obtain information related to the wearer based on the received information. For example, when the wearable device 100 includes an acceleration sensor, information transmitted from the wearable device 100 to the electronic apparatus 1000 may include information about physical movement of the wearable device 100. The electronic apparatus 1000 may determine a position (e.g., a sleep posture) of the wearer based on the information about physical movement of the wearable device 100.

Figure 11A:
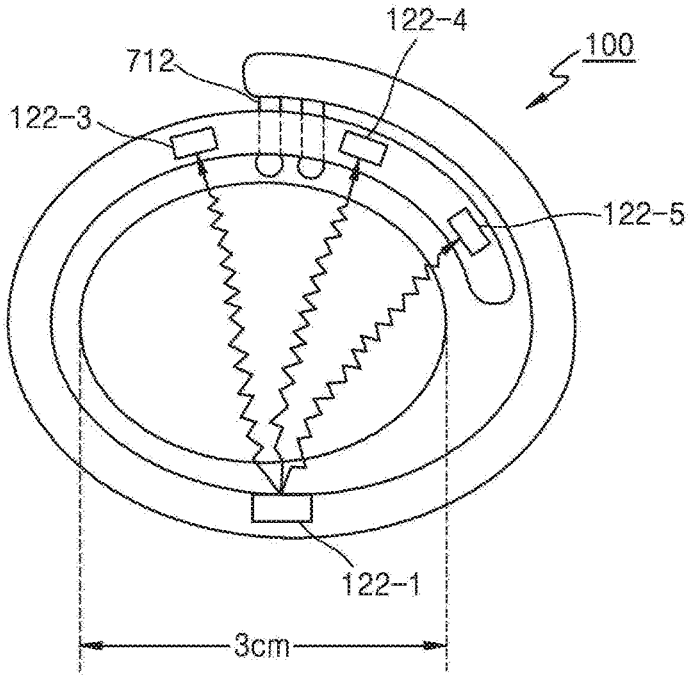
FIGS. 11A and 11B are conceptual diagrams for describing a method of obtaining information by using a sensor of a wearable device according to an embodiment of the present disclosure.
Figure 11B:
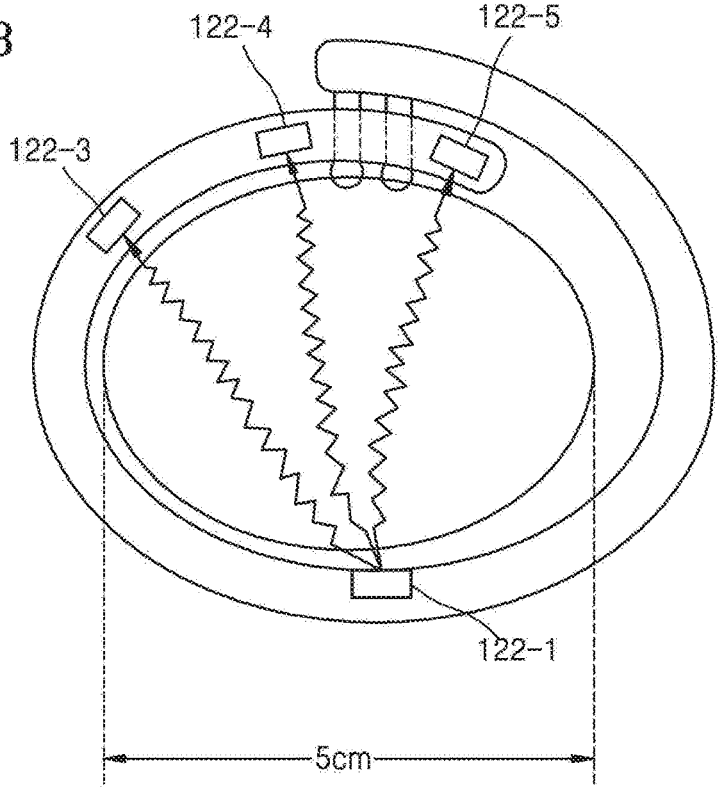

FIGS. 11A and 11B are conceptual diagrams for describing a method of obtaining information by using a sensor of a wearable device according to an embodiment of the present disclosure. FIGS. 11A and 11B are cross-sectional views of the wearable device of FIG. 9 worn on a body of a wearer.

Referring to FIGS. 11A and 11B, the body of the wearer has a width diameter of 3 cm in FIG. 11A, and in FIG. 11B, the body of the wearer has a width diameter of 5 cm.

The wearable device 100 may be fixed to the body of the wearer by using the fastening portion, that is, the protruding portion 712 in FIG. 11A. The emitter 122-1 including an LD may emit light while the wearable device 100 is fixed to the body. An optical signal emitted from the emitter 122-2 is scattered in the body, and the PDs 122-3 through 122-5 of the wearable device 100 may each receive the optical signal that penetrates through the body. The wearable device 100 may receive a PD that received a most satisfactory optical signal from among the PDs 122-3 through 122-5. For example, referring to FIG. 11A, the PD 122-4 or 122-5 may be selected. However, if a size of the body increases as shown in FIG. 11B, the wearable device 100 may select the PD 122-4 or 122-3. In other words, the wearable device 100 will activate only a PD that receives a signal having a greatest strength and deactivates the remaining PDs, thereby reducing power consumption. Alternatively, when at least one PD is not activated, the wearable device 100 may obtain information determined to have a most suitable value from among information received by a plurality of PDs as information detected by using a sensor.

Alternatively, according to another embodiment, an average value of values included in information received by a plurality of PDs may be obtained as information detected by using a sensor, or a sum of the values included in the information received by the plurality of PDs may be obtained as the information detected by using a sensor. Alternatively, information may be obtained by grouping a plurality of PDs. However, an embodiment is not limited thereto, and a method of obtaining, by the sensor unit 120 of the wearable device 100, information when the sensor unit 120 includes a plurality of sensors, such as a plurality of PDs, may vary according to various embodiments.

Figure 12A:
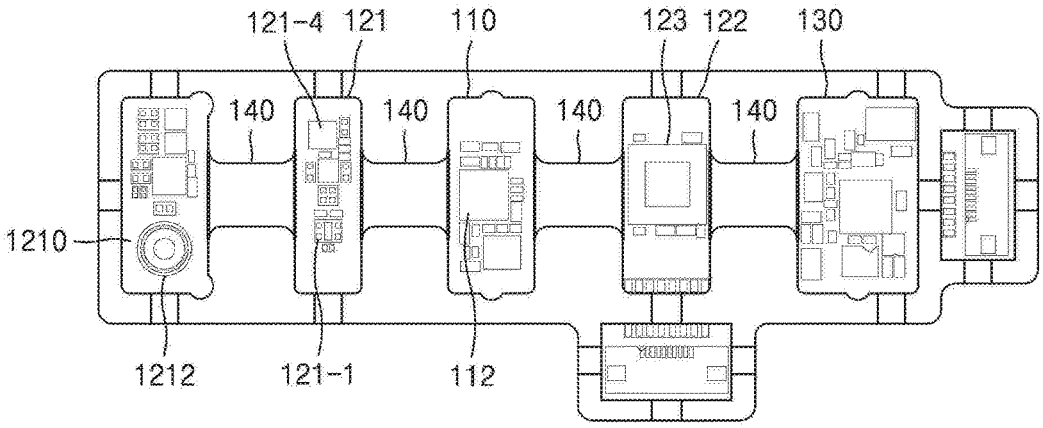
FIGS. 12A and 12B are circuit diagrams of a circuit included in a wearable device according to an embodiment of the present disclosure.
Figure 12B:
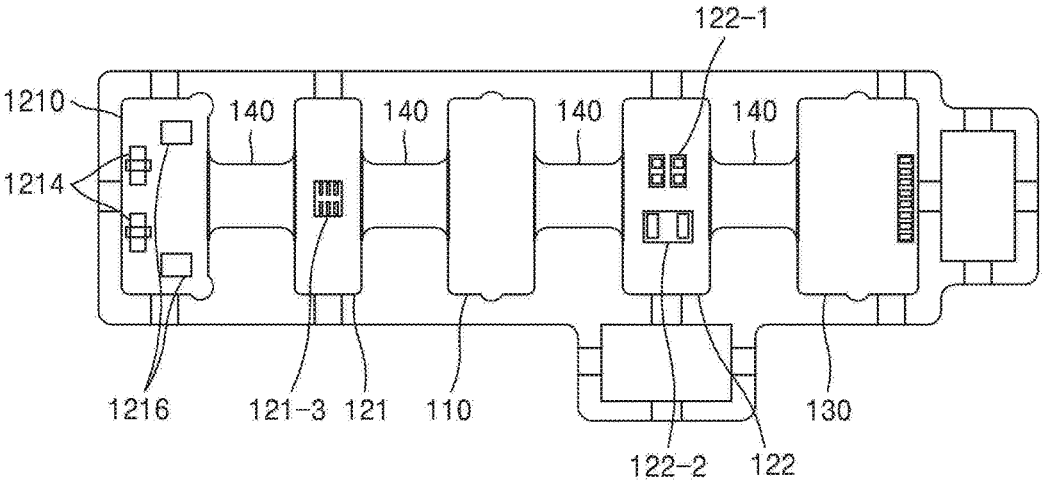

FIGS. 12A and 12B are circuit diagrams of a circuit included in the wearable device 100 according to an embodiment of the present disclosure. FIG. 12A is a plan view of the circuit included in the wearable device 100, and FIG. 12B is a bottom view of the circuit included in the wearable device 100. The circuit in FIGS. 12A and 12B are only an example, and is not limited thereto.

Referring to FIGS. 12A and 12B, the circuit included in the wearable device 100 according to an embodiment may include a power supplier 1210, the first sensor unit 121, the controller 110, the second sensor unit 122, and the communicator 130.

The power supplier 1210 may include a switch 1212 for turning on or off the wearable device 100, a power terminal 1214 connected to a power source (not shown), such as a batter, and a charging terminal 1216 for charging the battery.

The first sensor unit 121 may include the temperature sensor 121-1 for measuring an external atmospheric temperature or a temperature, an acceleration sensor 121-4 for measuring movement of the wearable device 100, and the body temperature sensor 121-3 for measuring a body temperature of the wearer. As shown in FIGS. 12A and 12B, the temperature sensor 121-1 and the body temperature sensor 121-3 may be provided on opposite sides of a PCB. Alternatively, the temperature sensor 121-1 and the body temperature sensor 121-3 may be provided together in the controller 110 or the second sensor unit 122, but an embodiment is not limited thereto.

The second sensor unit 122 may include a light sensing unit 123. The light sensing unit 123 may obtain information, such as oxygen saturation, pulse, and respiration, by using the emitter 122-1 and the optical receiver 122-2 provided opposite to the PCB.

The controller 110 may include a microcontroller that processes data and controls each component of the wearable device 100.

The communicator 130 may externally transmit information obtained through the first and second sensor units 121 and 122, via a short-distance wireless communication. For example, the communicator 130 may transmit information by using Bluetooth low energy (BLE).

The connector 140 electrically connects at least two components. Also, the connector 140 may be formed of a flexible material for a shape change of the wearable device 100.

FIGS. 13 to 16 illustrate information displayed on an electronic apparatus according to various embodiments of the present disclosure.

Figure 13:
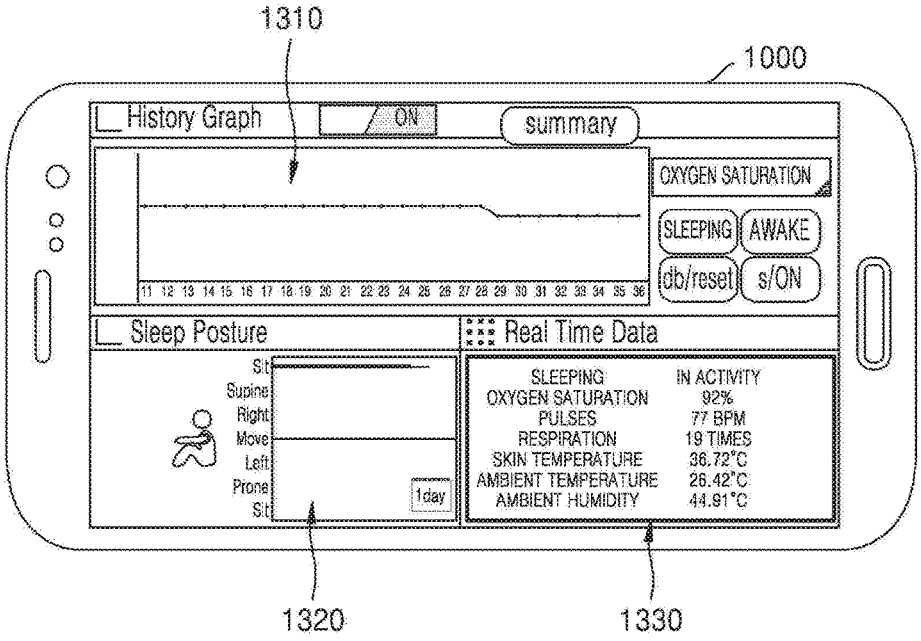
FIGS. 13 to 16 illustrate information displayed on an electronic apparatus according to various embodiments of the present disclosure.

Referring to FIG. 13, the electronic apparatus 1000 may display a history 1310 of information obtained through the wearable device 100, posture information 1320, and real-time data 1330.

The history 1310 of the information obtained through the wearable device 100 may be shown in a graph of information received in the past. Also, the posture information 1320 may include information about a position of the wearer, which is estimated based on an acceleration value received through the wearable device 100. Also, the real-time data 1330 may include information lastly received from the wearable device 100 and information related to the lastly received information. According to an embodiment, the information lastly received from the wearable device 100 may include oxygen saturation, pulse, a skin temperature, an ambient atmospheric temperature, ambient humidity, and a respiration rate per hour, but is not limited thereto. Information related to the lastly received information may include information generated by the electronic apparatus 1000 based on the lastly received information. For example, the electronic apparatus 1000 may determine a state of the wearer based on the pulse rate and the respiration rate per hour. The state may be information indicating whether the wearer is sleeping or awake. When the pulse rate and the respiration rate per hour are equal to or higher than a threshold value, the electronic apparatus 1000 may determine that the wearer is awake. The threshold value is an experimental value and may vary according to various embodiments.

Figure 14:
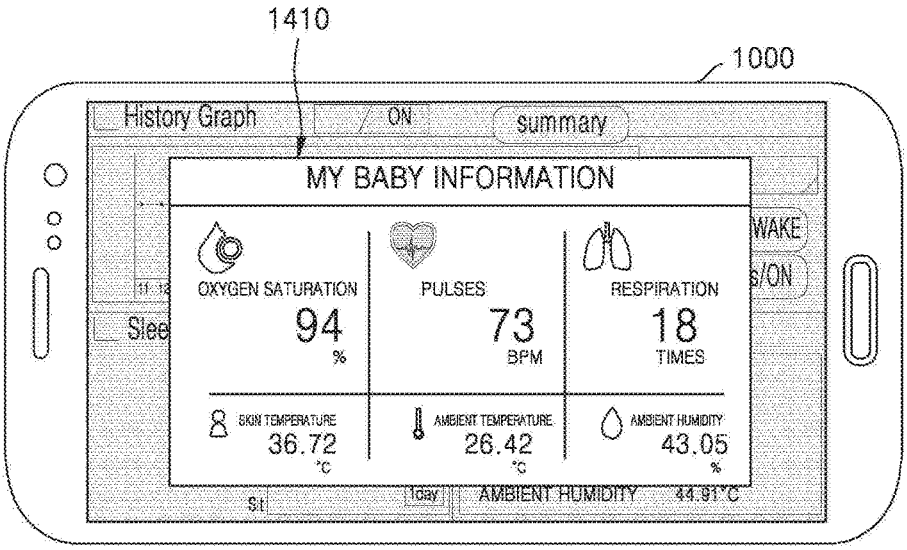

Referring to FIG. 14, the electronic apparatus 1000 may display abstract information 1410 of the real-time data 1330 in a separate window. The electronic apparatus 1000 may display the abstract information 1410 including information about oxygen saturation, pulse rate, respiration, a skin temperature, an ambient temperature, and ambient humidity obtained through the wearable device 100, on a window for displaying the abstract information 1410.

Also, according to an embodiment, the electronic apparatus 1000 may determine whether a state of the wearer wearing the wearable device 100 is normal based on information received from the wearable device 100. For example, the electronic apparatus 1000 may determine whether the pulse, the respiration rate per hour, and the oxygen saturation received from the wearable device 100 are within a pre-set range or within a range set by a user of the electronic apparatus 1000. In other words, the electronic apparatus 1000 may determine whether information obtained by using the wearable device 100 is within a normal range.

Figure 15:
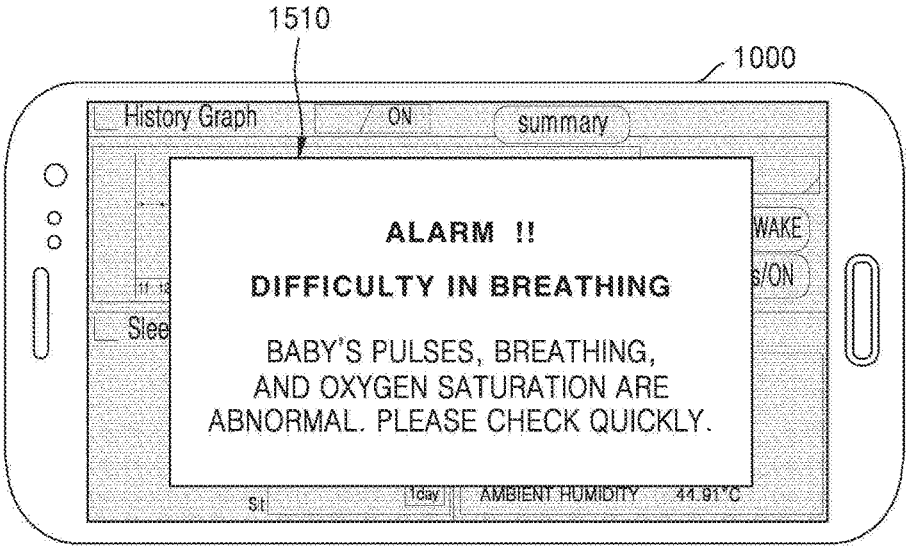

Referring to FIG. 15, when at least one of the pulse rate, the respiration rate per hour, and the oxygen saturation is outside the normal range, the electronic apparatus 1000 may display an alarm message 1510. For example, the electronic apparatus 1000 may determine the state of the wearer of the wearable device 100 based on the information received from the wearable device 100. When at least one of the pulse rate, the respiration rate per hour, and the oxygen saturation is outside the normal range, the electronic apparatus 1000 may determine that the state of the wearer is not normal. When it is determined that the state of the wearer is not normal, the electronic apparatus 1000 may display the alarm message 1510.

According to another embodiment, the electronic apparatus 1000 may determine whether the wearable device 100 is suitably worn on the body of the wearer based on the information received from the wearable device 100. For example, when sensor information received from the wearable device 100 is outside a pre-set range (e.g., lower than or equal to a first threshold value and equal to or higher than a second threshold value), the electronic apparatus 1000 may determine that the sensor information has an error or the wearable device 100 is unsuitably worn on the body of the wearer. In this case, the electronic apparatus 1000 may display alarm information guiding the wearer to adjust a wearing state of the wearable device 100 or to adjust a position of a sensor.

Figure 16:
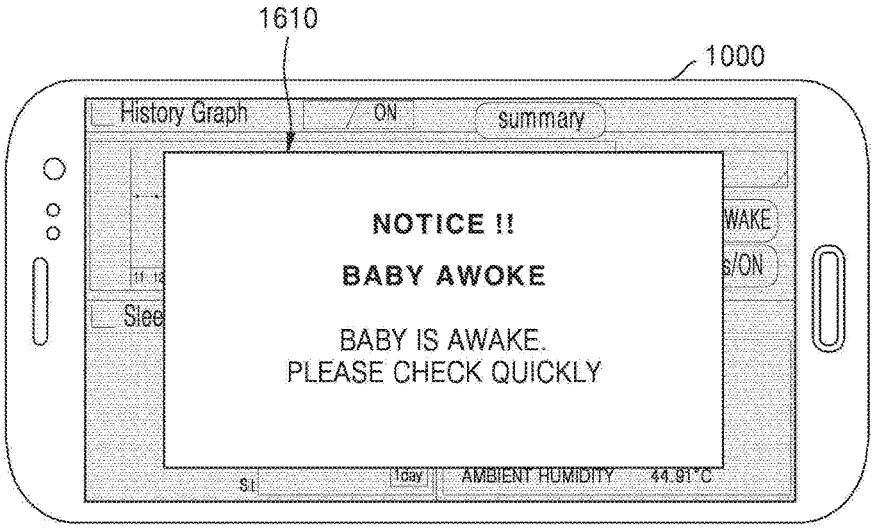

Referring to FIG. 16, according to an embodiment, when the state of the wearer of the wearable device 100 is changed from a sleeping state to a woken state, the electronic apparatus 1000 may display a message 1610 indicating that the wearer is awake. According to another embodiment, the electronic apparatus 1000 may predict a time when the wearer wakes up based on information received from the wearable device 100. The electronic apparatus 1000 may display the message 1610 indicating that the wearer is awake according to the predicted time.

However, information is not limitedly displayed on the electronic apparatus 1000 of FIGS. 13 to 16. For example, the information of FIGS. 13 to 16 may be displayed on a display included in another device, such as a refrigerator, a washing machine, a TV, or a wearable device other than the wearable device 100. As another example, when the wearable device 100 includes a display, the information of FIGS. 13 to 16 may be displayed on the display of the wearable device 100. Also, the information of FIGS. 13 to 16 may be displayed on at least one device by being transmitted to the at least one device. Also, the information of FIGS. 13 to 16 may be displayed on a device currently used by a user from among devices connected through IoT.

Also, according to another embodiment, the wearable device 100 may include at least one of a speaker (not shown) and a color displayer (not shown). The speaker may output a sound signal according to an electric signal. The wearable device 100 including the speaker may output alarm sound by using the speaker when an alarm message is to be displayed as in FIG. 15 or 16. The color displayer outputs colored light according to an electric signal. For example, when an alarm message is to be displayed as in FIG. 15 or 16, the color displayer may output red light by using a device for outputting light, such as a light emitting diode (LED).

Figure 17:
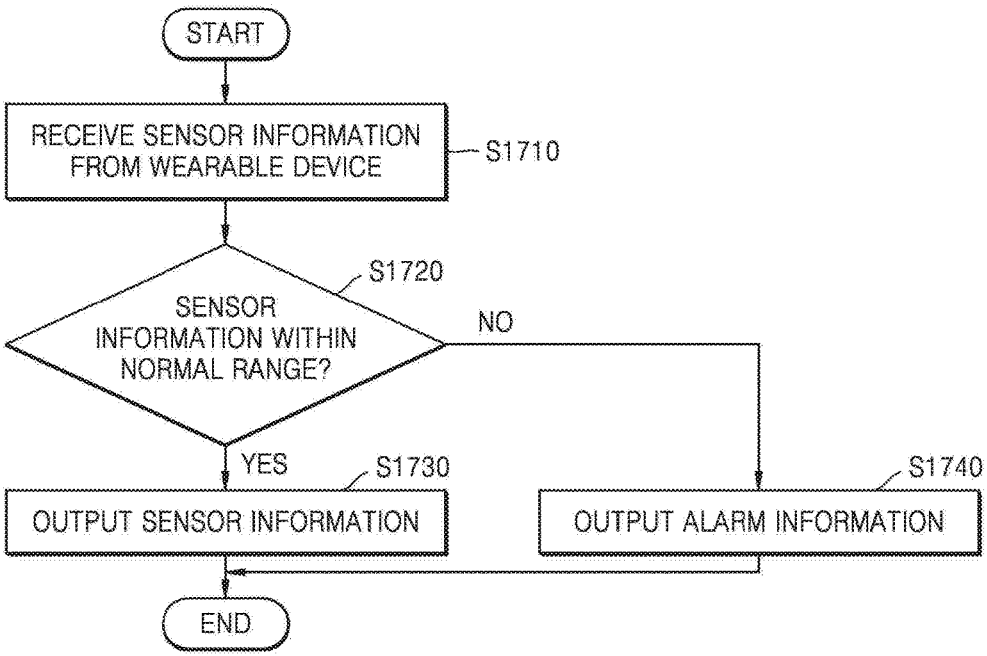
FIG. 17 is a flowchart of a method of providing, by an electronic apparatus, information according to an embodiment of the present disclosure.

FIG. 17 is a flowchart of a method of providing, by an electronic apparatus, information according to an embodiment of the present disclosure.

Referring to FIG. 17, in operation S1710, the electronic apparatus 1000 may receive, from the wearable device 100, sensor information that is information obtained by using a sensor included in the wearable device 100. When there is the wearable device 100 communicably connected to the electronic apparatus 1000 before operation S1710, the electronic apparatus 1000 may receive the sensor information from the wearable device 100 in operation S1710. According to an embodiment, the electronic apparatus 1000 may be initially communicably connected to the wearable device 100 according to control of a user, and then store information for establishing communication connection with the wearable device 100, thereby automatically communicably connecting to the wearable device 100 later. For example, when the electronic apparatus 1000 is turned on, the electronic apparatus 1000 may be automatically communicably connected to the wearable device 100 having a history of communication connection. Alternatively, in operation S1710, the electronic apparatus 1000 may receive sensor information broadcasted by the wearable device 100.

In operation S1720, the electronic apparatus 1000 may determine whether the sensor information is within a normal range. In order to determine whether the sensor information is within the normal range, information about the normal range may be pre-stored in the electronic apparatus 1000 or may be downloaded to the electronic apparatus 1000 from an external source through a network. When it is determined that the sensor information is within the normal range, the electronic apparatus 1000 may output the sensor information in operation S1730. Whether the sensor information is included in the normal range may be determined according to various embodiments. For example, referring to FIG. 33, when the sensor information includes information about oxygen saturation, it may be determined that the sensor information is within the normal range if the oxygen saturation is equal to or higher than 95%. Also, when the sensor information includes information about a heart rate, it may be determined that the sensor information is within the normal range if the heart rate is between 120 to 140 times. Also, when the sensor information includes information about a respiration rate per minute, it may be determined that the sensor information is within the normal range if the respiration rate per minute is between 30 to 40 times. Also, when the sensor information includes information about a body temperature, it may be determined that the sensor information is within the normal range if the body temperature is between 36.8 to 37.3° C. Also, the electronic apparatus 1000 may determine whether the sensor information is within the normal range based on a combination of at least two pieces of information. When it is determined that the sensor information is outside the normal range, the electronic apparatus 1000 may output alarm information indicating that the state of the wearer of the wearable device 100 is not normal, in operation S1740. The alarm information may be embodied in any one of various forms, such as a message displayed on a display, pre-set colored light, an icon, sound, or vibration.

According to another embodiment, the electronic apparatus 1000 may determine whether the wearable device 100 is suitably worn on a body of the wearer based on information received from the wearable device 100. For example, when the sensor information is outside a pre-set range (e.g., lower than or equal to a first threshold value and equal to or higher than a second threshold value), the electronic apparatus 1000 may determine that the sensor information has an error or the wearable device 100 is unsuitably worn on the body of the wearer. In this case, the electronic apparatus 1000 may output the alarm information guiding the wearer to adjust a wearing state of the wearable device 100 or to adjust a position of a sensor.

According to another embodiment, the wearable device 100 may determine whether the information obtained by the wearable device 100 is within a pre-set range or within a range set by a user of the wearable device 100, that is, within the normal range.

When it is determined that the obtained information is within the normal range, the wearable device 100 may transmit the obtained information to the electronic apparatus 1000 through the communicator 130. Alternatively, when it is determined that the obtained information is outside the normal range, the wearable device 100 may transmit alarm information indicating that the state of the wearer is not normal to the electronic apparatus 1000 through the communicator 130.

Figure 18:
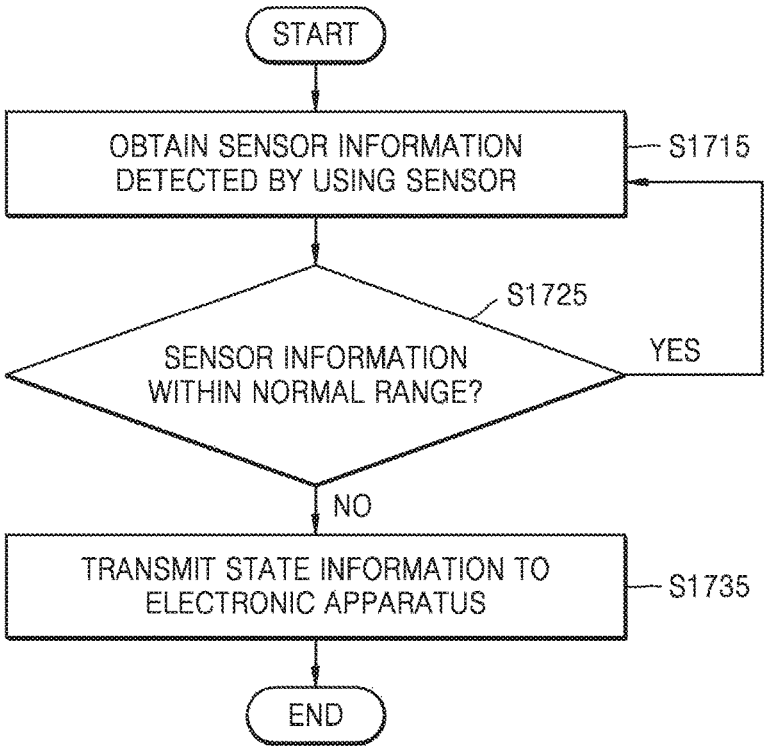
FIG. 18 is a flowchart of a method of determining, by a wearable device, whether obtained information is within a normal range according to an embodiment of the present disclosure.

FIG. 18 is a flowchart of a method of determining, by a wearable device, whether obtained information is within a normal range according to an embodiment of the present disclosure.

Referring to FIG. 18, in operation S1715, the wearable device 100 may obtain sensor information detected by using a sensor included in the sensor unit 120. The wearable device 100 may determine whether the sensor information is within a normal range in operation S1725. Whether the sensor information is included in the normal range may be determined according to various embodiments. For example, referring to FIG. 33, when the sensor information includes information about oxygen saturation, it may be determined that the sensor information is within the normal range if the oxygen saturation is equal to or higher than 95%. Also, when the sensor information includes information about a heart rate, it may be determined that the sensor information is within the normal range if the heart rate is between 120 to 140 times. Also, when the sensor information includes information about a respiration rate per minute, it may be determined that the sensor information is within the normal range if the respiration rate per minute is between 30 to 40 times. Also, when the sensor information includes information about a body temperature, it may be determined that the sensor information is within the normal range if the body temperature is between 36.8 to 37.3° C. Also, the wearable device 100 may determine whether the sensor information is within the normal range based on a combination of at least two pieces of information.

According to another embodiment, the electronic apparatus 1000 may determine whether the wearable device 100 is suitably worn on a body of the wearer based on information received from the wearable device 100. For example, when the sensor information is outside a pre-set range (e.g., less than or equal to a first threshold value and greater than or equal to a second threshold value), the electronic apparatus 1000 may determine that the sensor information has an error or the wearable device 100 is unsuitably positioned on the body of the wearer. In this case, the electronic apparatus 1000 may output the alarm information guiding the wearer to adjust a wearing state of the wearable device 100 or to adjust a position of a sensor.

When it is determined that the sensor information is not within the normal range, the wearable device 100 may transmit state information to the electronic apparatus 1000, in operation S1735. When the electronic apparatus 1000 communicably connected to the wearable device 100 exists before operation S1735, the wearable device 100 may directly transmit the state information to the electronic apparatus 1000. According to an embodiment, the wearable device 100 may be initially communicably connected to the electronic apparatus 1000 according to control of a user, and then store information for establishing communication connection with the electronic apparatus 1000, thereby automatically communicably connecting to the electronic apparatus 1000 later. For example, when the wearable device 100 is turned on, the wearable device 100 may be automatically communicably connected to the electronic apparatus 1000 having a history of communication connection. Alternatively, when there is no electronic apparatus communicably connected to the wearable device 100, the wearable device 100 may broadcast the state information in operation S1735 to notify an emergency. According to an embodiment, the state information may include at least one of the sensor information, alarm information indicating that the sensor information is outside the normal range, alarm information indicating that the wearable device 100 is not suitably worn, alarm information guiding the wearer to adjust the wearing state of the wearable device 100, and alarm information guiding the wearer to adjust the location of the sensor.

Figure 19:
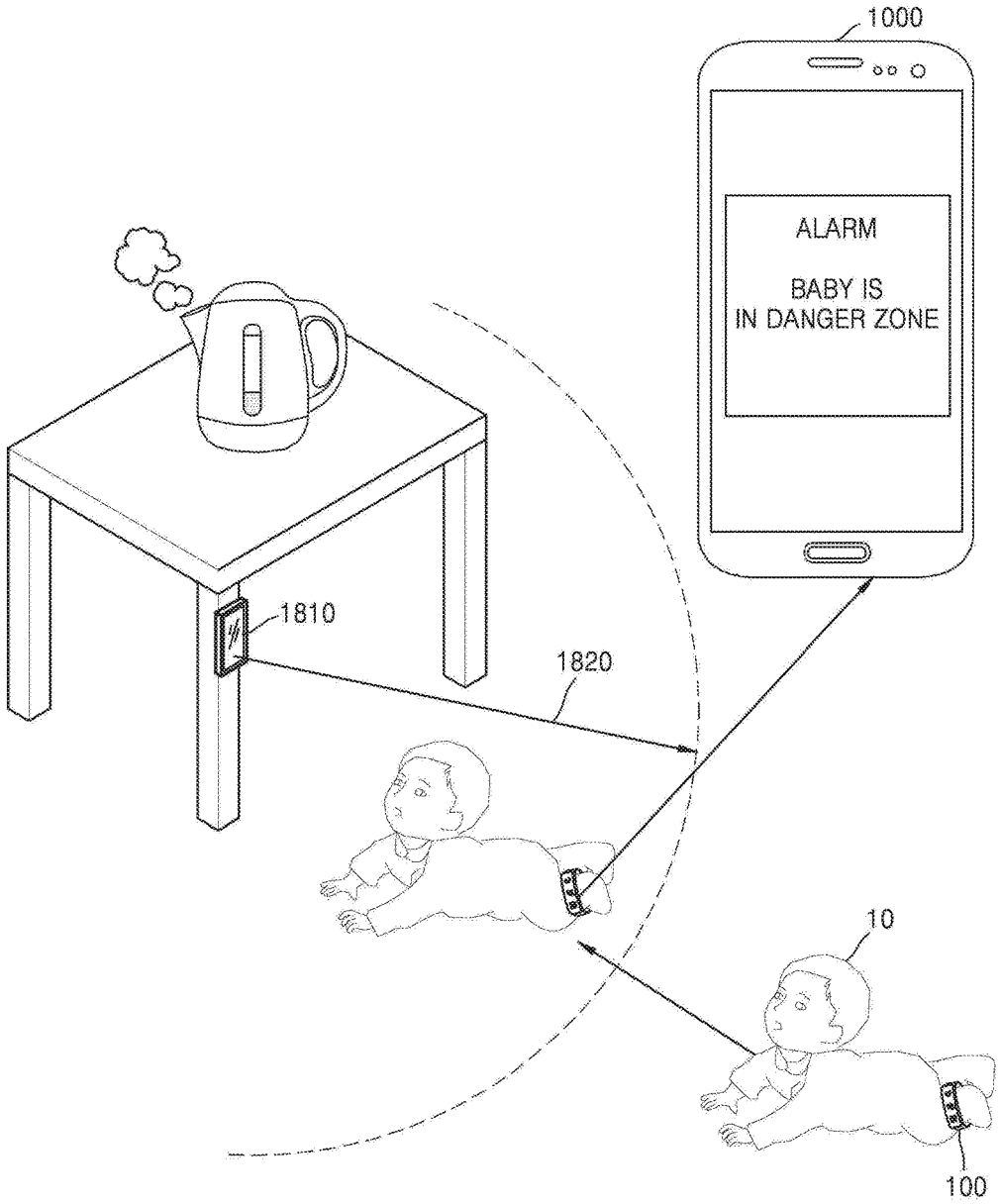
FIG. 19 is a diagram for describing a method of providing information by using a system for providing information according to an embodiment of the present disclosure.

FIG. 19 is a diagram for describing a method of providing information by using a system according to an embodiment of the present disclosure.

Referring to FIG. 19, the wearable device 100 may receive a short-distance wireless communication signal from a beacon 1810 broadcasting identification (ID) information via a short-distance wireless communication. The short-distance wireless communication signal may be a signal for performing communication within a short distance. For example, the short-distance wireless communication signal may be a wireless communication signal according to BLE standards, a wireless communication signal according to Wi-Fi standards, or a signal according to Zigbee standards, but is not limited thereto. The wearable device 100 may determine a relative location of the beacon 1810 based on the short-distance wireless communication signal. In other words, the wearable device 100 determines a distance between the beacon 1810 and the wearable device 100. For example, the wearable device 100 may determine the distance based on received signal strength indication (RSSI) from the beacon 1810. When the distance is less than or equal to a pre-set distance 1820 as a wearer 10 of the wearable device 100 moves, the wearable device 100 may transmit an alarm message to the electronic apparatus 1000.

Alternatively, the wearable device 100 may transmit information about the short-distance wireless communication signal to the electronic apparatus 1000. The electronic apparatus 1000 may display an alarm message based on the information about the short-distance wireless communication signal. For example, the electronic apparatus 1000 may receive information about strength of the short-distance wireless communication signal, and determine the distance between the wearable device 100 and the beacon 1810 based on the information about the strength. When the distance between the wearable device 100 and the beacon 1810 is within the pre-set distance 1820, the electronic apparatus 1000 may display the alarm message.

The beacon 1810 of FIG. 19 may be replaced by another apparatus capable of broadcasting a short-distance wireless communication signal. For example, the beacon 1810 may be a certain IoT device. In other words, an apparatus that is dangerous and included in an IoT environment, such as an iron or an electric heater, may perform operations of the beacon 1810. According to an embodiment, an apparatus that is classified to be dangerous only while being used may broadcast a short-distance wireless communication signal only while being used. Whether an apparatus is dangerous may be determined according to various embodiments. For example, a user may set whether an apparatus is dangerous through a mobile terminal or IoT hub connected to IoT. As another example, an apparatus may be determined to be dangerous according to standards set by an application interworking with the wearable device 100. As another example, the wearable device 100 may receive standards for determining whether an apparatus is dangerous from an external server, and determine whether an apparatus is dangerous based on the received standards.

Figure 20:
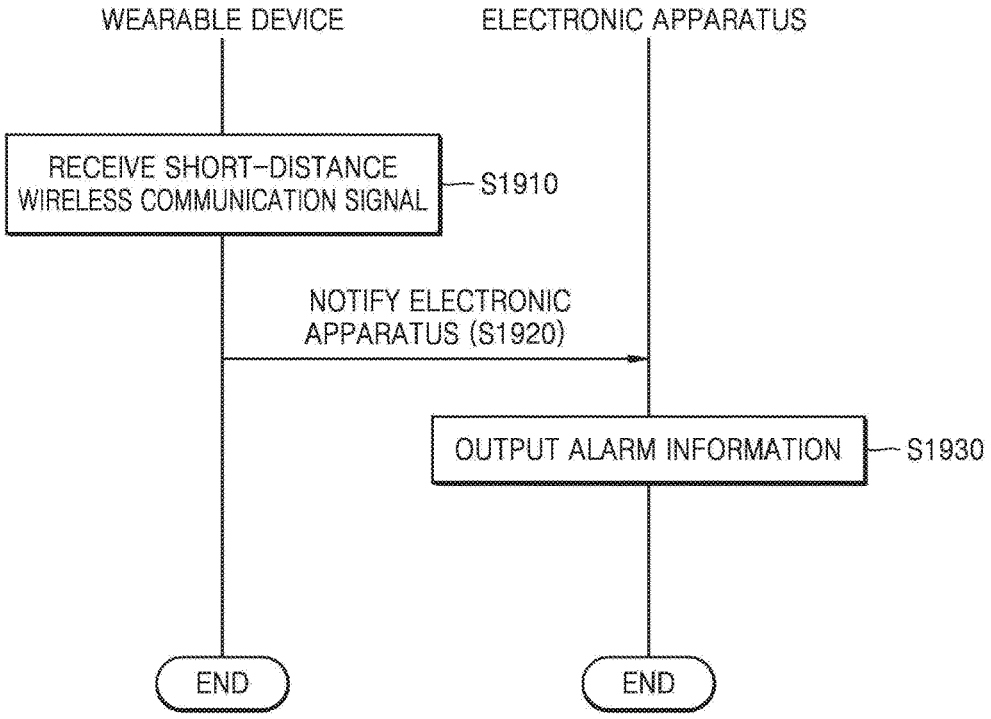
FIG. 20 is a flowchart of a method of providing, by a system, information according to an embodiment of the present disclosure.

FIG. 20 is a flowchart of a method of providing, by a system, information according to an embodiment of the present disclosure.

Referring to FIG. 20, in operation S1910, the wearable device 100 may receive a short-distance wireless communication signal. Then, in operation S1920, the wearable device 100 may notify the electronic apparatus 1000 that the short-distance wireless communication signal is received.

According to an embodiment, the wearable device 100 may determine a distance between the wearable device 100 and a location where the short-distance wireless communication signal is transmitted based on RSSI. When the distance is lower than or equal to a pre-set value, the wearable device 100 may transmit alarm information to the electronic apparatus 1000 in operation S1920. Then, in operation S1930, the electronic apparatus 1000 may output the alarm information. For example, when the wearable device 100 worn on a baby receives the short-distance wireless communication signal from the beacon 1810 as shown in FIG. 19, the wearable device 100 may transmit the alarm information to a smart phone of the baby's mother. Upon receiving the alarm information, the smart phone may display the alarm information, generate alarm sound, or transmit the alarm information to a device currently used by the mother (e.g., a TV if the mother is watching the TV).

According to another embodiment, the wearable device 100 may transmit information about the short-distance wireless communication signal to the electronic apparatus 1000, in operation S1920. For example, the wearable device 100 may transmit strength of the short-distance wireless communication signal to the electronic apparatus 1000. However, an embodiment is not limited thereto. The electronic apparatus 1000 may determine whether to output the alarm information based on the information about the short-distance wireless communication signal. The electronic apparatus 1000 may output the alarm information in operation S1930 based on a result of the determining.

Figure 21:
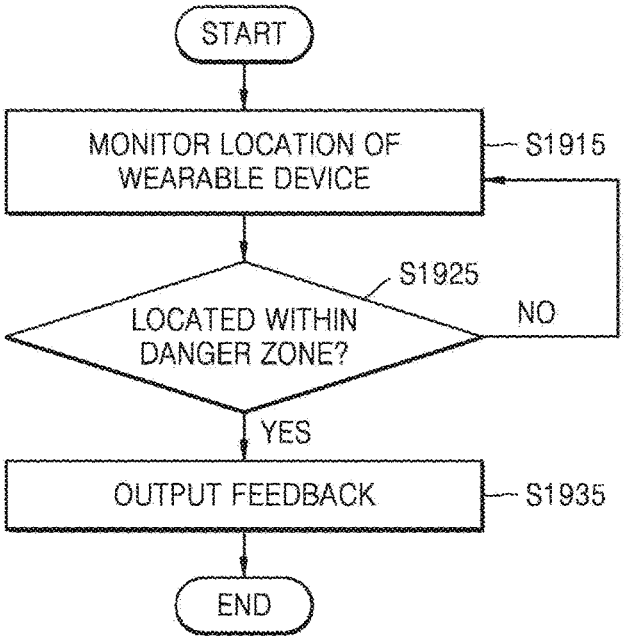
FIG. 21 is a flowchart of a method of outputting by a system, feedback according to an embodiment of the present disclosure.

FIG. 21 is a flowchart of a method of outputting, by a system, feedback according to an embodiment of the present disclosure.

Referring to FIG. 21, in operation S1915, the wearable device 100 may monitor a location of the wearable device 100. According to an embodiment, the wearable device 100 may monitor the location of the wearable device 100 by calculating a distance between the wearable device 100 and another device (e.g., the beacon 1810 of FIG. 18) by using a wireless communication signal broadcasted from the other apparatus. However, an embodiment is not limited thereto.

Then, in operation S1925, the wearable device 100 may determine whether the wearable device 100 is located within a danger zone. For example, the wearable device 100 may receive a wireless communication signal broadcasted from an external apparatus, and determine whether the external apparatus is a dangerous apparatus and a distance between the external apparatus and the wearable device 100 based on the wireless communication signal. Whether the external apparatus is a dangerous apparatus may be determined by using any one of various methods. For example, the wearable device 100 may determine a type of the external apparatus based on ID information of the external apparatus included in the wireless communication signal, and determine whether the external apparatus is a dangerous apparatus. As another example, the wireless communication signal may include information indicating that the external apparatus is a dangerous apparatus. However, an embodiment is not limited thereto, and another arbitrary method may be used to determine whether the external apparatus is a dangerous apparatus. When it is determined that the distance between the wearable device 100 and the external apparatus is less than or equal to a threshold value (e.g., 1 m), the wearable device 100 may determine that the wearable device 100 is located within the danger zone.

When it is determined that the wearable device 100 is located within the danger zone, the wearable device 100 may output feedback in operation S1935. The feedback may be output so as to attract the attention of the wearer (i.e., specifically if the wearer is an infant) of the wearable device 100 in the danger zone and entices the wearer to another location so that the wearer moves away from the danger zone. A method of outputting feedback may vary according to various embodiments. According to an embodiment, the wearable device 100 may output an alarm sound. The alarm sound may be replaced by a parent's voice calling the wearer of the wearable device 100, wearer's favorite music, or vibration using a vibration motor included in the wearable device 100, but a replacement of the alarm sound is not limited thereto. Alternatively, the wearable device 100 may request the electronic apparatus 1000 to output the feedback. The electronic apparatus 1000 may be a terminal or IoT apparatus of a guardian who is not in the danger zone. The feedback may be output in any one of various forms, such as sound, vibration, and an alarm message. For example, the parent's voice calling an infant, or infant's favorite image or music may be output.

According to an embodiment, when it is determined that the wearable device 100 is in the danger zone in operation S1925, a danger level of the wearer of the wearable device 100 may be gradationally determined based on the distance between the wearable device 100 and the external apparatus. For example, when the distance between the wearable device 100 and the external apparatus is equal to or higher than 0.5 m and lower than 1 m, the wearable device 100 may determine that the danger level is a first level. Also, when the distance is less than 0.5 m, the wearable device 100 may determine that the danger level is a second level. In this case, the wearable device 100 may determine the feedback to be output in operation S1935 according to the danger level. For example, when the danger level is determined to be the first level, the wearable device 100 may output an alarm sound. Also, when the danger level is determined to be the second level, the wearable device 100 may the output alarm sound with vibration by using the vibration motor included in the wearable device 100. Alternatively, the feedback to be output may be gradationally selected according to a danger level indicated by ID information of the external apparatus, based on the ID information included in the wireless communication signal.

Figure 22:
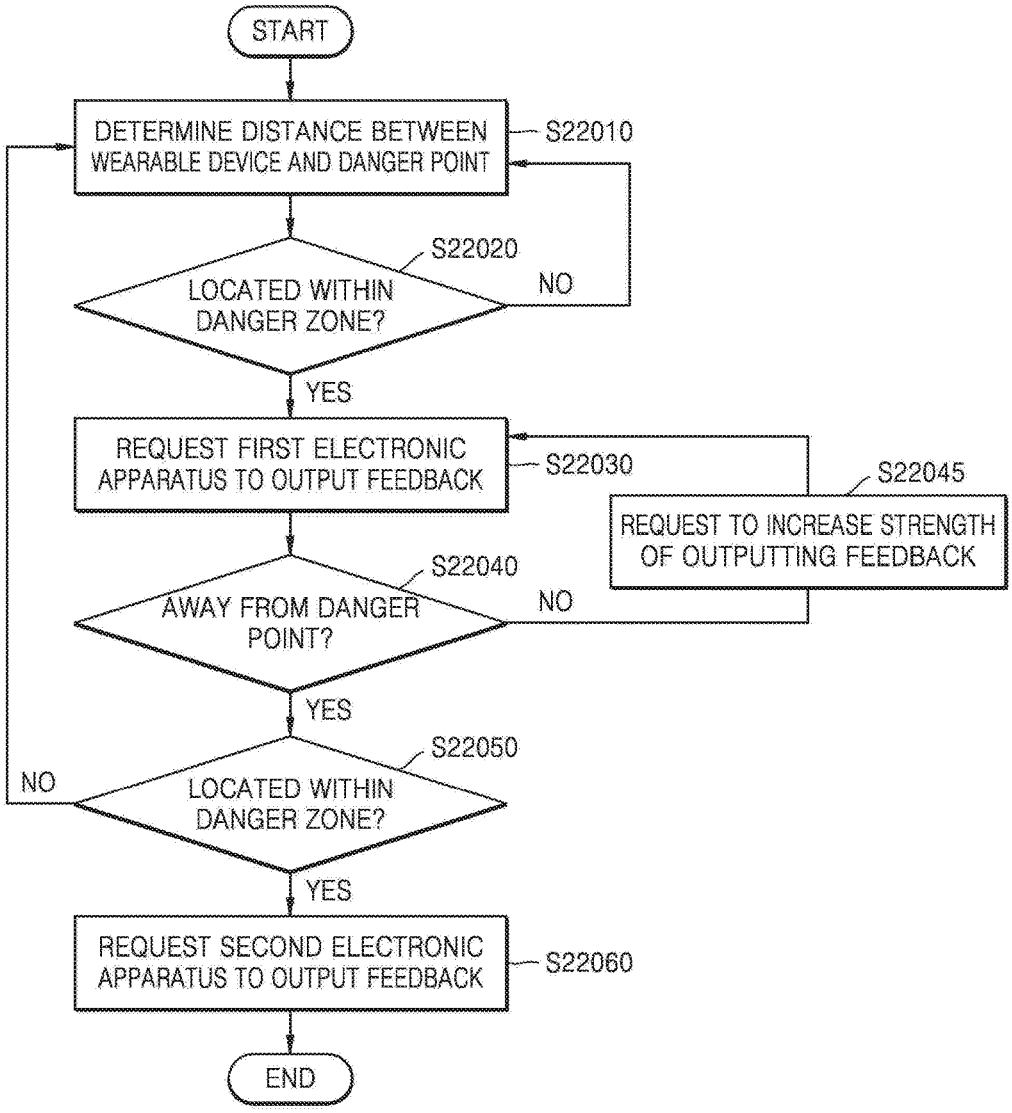
FIG. 22 is a flowchart of a method of outputting by a system, feedback according to another embodiment of the present disclosure.

FIG. 22 is a flowchart of a method of outputting, by the system, feedback according to another embodiment of the present disclosure. The method of FIG. 22 may be performed by the wearable device 100, but an embodiment is not limited thereto.

Referring to FIG. 22, in operation S22010, the wearable device 100 may determine a distance between the wearable device 100 and a danger point in order to monitor wither the wearable device 100 is located within a danger zone. The danger point may be a location of an object recognizable by the wearable device 100. For example, the danger point may be a location where the beacon 1810 of FIG. 18 or an IoT apparatus broadcasting a short-distance wireless communication signal is located.

Then, in operation S22020, the wearable device 100 may determine whether the wearable device 100 is located within the danger zone based on the distance between the wearable device 100 and the danger point. When it is determined that the wearable device 100 is located within the danger zone, the wearable device 100 may request a first electronic apparatus to output feedback, in operation S22030. The first electronic apparatus that is to output the feedback may be determined in any one of various methods. According to an embodiment, the first electronic apparatus may be a terminal communicably connected to the wearable device 100, for example, a parent's smart phone. According to another embodiment, considering the danger point and a location of the wearable device 100, the first electronic apparatus may be an IoT device located at a point suitable for inducing the wearer of the wearable device 100 to move outside the danger zone. For example, the first electronic apparatus may reproduce a parent's voice in order to induce an infant wearing the wearable device 100 in a direction where the first electronic apparatus is located. According to another embodiment, the first electronic apparatus may be a device at a fixed location, such as a TV.

In operation S22040, the wearable device 100 may determine whether the wearable device 100 is away from the danger point. When it is determined that the wearable device 100 is not away from the danger point, the wearable device 100 may request the first electronic apparatus to increase strength of the outputting of the feedback in operation S22045. For example, the wearable device 100 may increase volume of sound output from the first electronic apparatus. As another example, the wearable device 100 may generate vibration by using the vibration motor, in addition to the sound.

When it is determined that the wearable device 100 is away from the danger point, the wearable device 100 determines whether the wearable device 100 is located within the danger zone in operation S22050. When it is determined that the wearable device 100 is still located in the danger zone, the wearable device 100 may select a second electronic apparatus suitable for outputting feedback according to a current location of the wearable device 100, and request the second electronic apparatus to output feedback.

Figure 23:
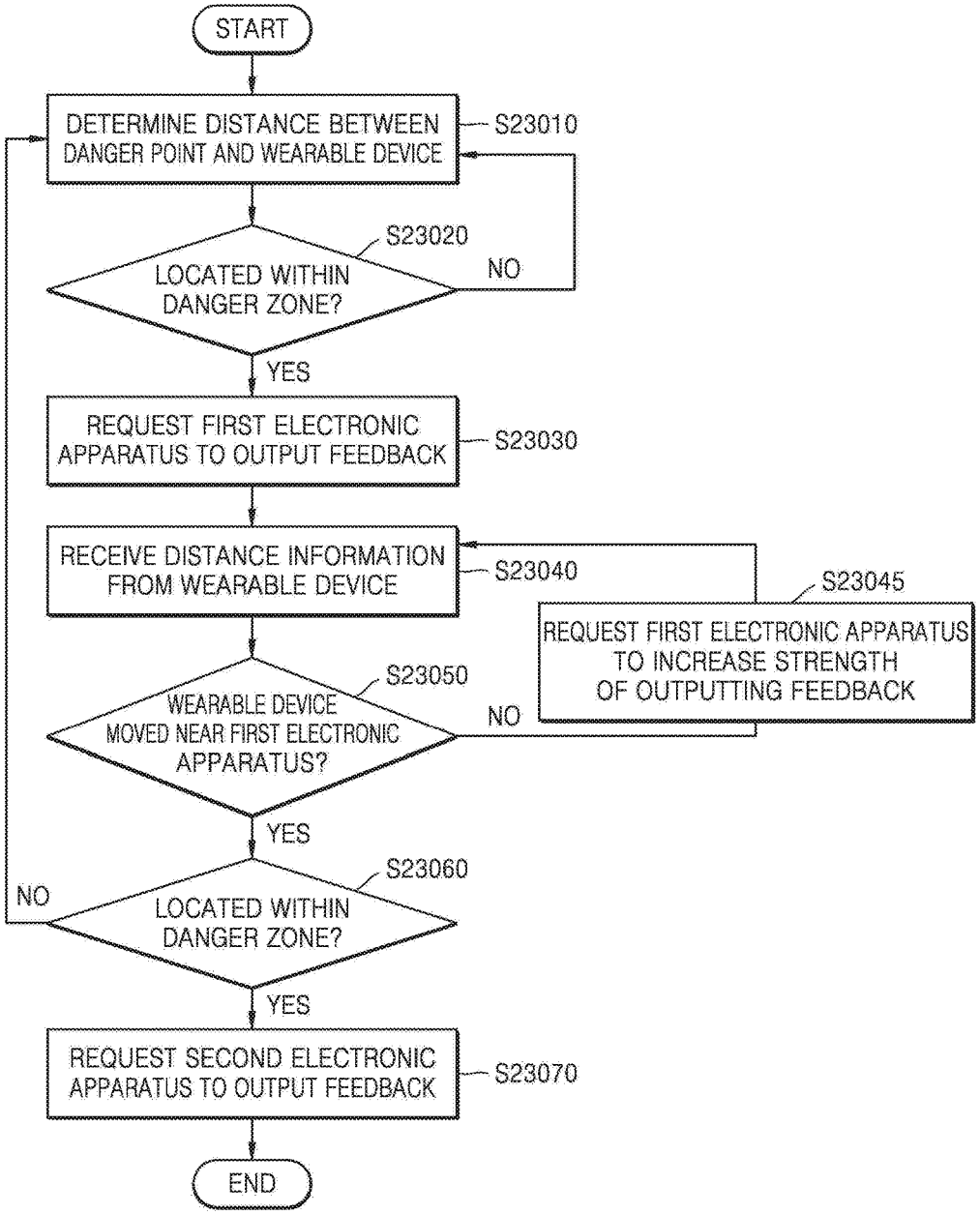
FIG. 23 is a flowchart of a method of outputting by a system, feedback according to another embodiment of the present disclosure.

FIG. 23 is a flowchart of a method of outputting, by the system, feedback according to another embodiment of the present disclosure. The method of FIG. 23 may be performed by an apparatus, such as a terminal or IoT hub, connected to the wearable device 100, but an embodiment is not limited thereto. For convenience of description, the method of FIG. 23 is performed by a relay apparatus.

Referring to FIG. 23, in operation S23010, the relay apparatus may determine a distance between a danger point and the wearable device 100 in order to monitor whether the wearable device 100 is located within a danger zone. The danger point may be a location where an object recognizable by the wearable device 100 is located. For example, the danger point may be a location where the beacon 1810 of FIG. 18 or an IoT apparatus broadcasting a short-distance wireless communication signal is located. In order to determine the distance between the danger point and the wearable device 100, the relay apparatus may receive, from the wearable device 100, information about the distance between the danger point and the wearable device 100 or about strength of a wireless communication signal received by the wearable device 100.

In operation S23020, the relay apparatus may determine whether the wearable device 100 is located within a danger zone based on the distance between the danger point and the wearable device 100. When it is determined that the wearable device 100 is located within the danger zone, the relay apparatus may request a first electronic apparatus to output feedback, in operation S23030. The first electronic apparatus may vary according to various embodiments.

In operation S23040, the relay apparatus receives, from the wearable device 100, distance information including the distance between the danger point and the wearable device 100 or the strength of the wireless communication signal. In operation S23050, the relay apparatus may determine whether the wearable device 100 has moved nearer to the first electronic apparatus based on the distance information. When it is determined that the wearable device 100 did not move nearer to the first electronic apparatus, the relay apparatus may request the first electronic apparatus to increase a strength of the outputting of the feedback, in operation S23045. The relay apparatus may request the wearable device 100 to generate a vibration.

When it is determined that the wearable device 100 has moved nearer to the first electronic apparatus, the relay apparatus may determine again whether the wearable device 100 is located within the danger zone, in operation S23060. When it is determined that the wearable device 100 is not located within the danger zone, the relay apparatus stops the outputting of the feedback and continuously monitors the location of the wearable device 100. When it is determined that the wearable device 100 is located within the danger zone, the relay apparatus may request a second electronic apparatus to output feedback, in operation S23070.

Figure 24:
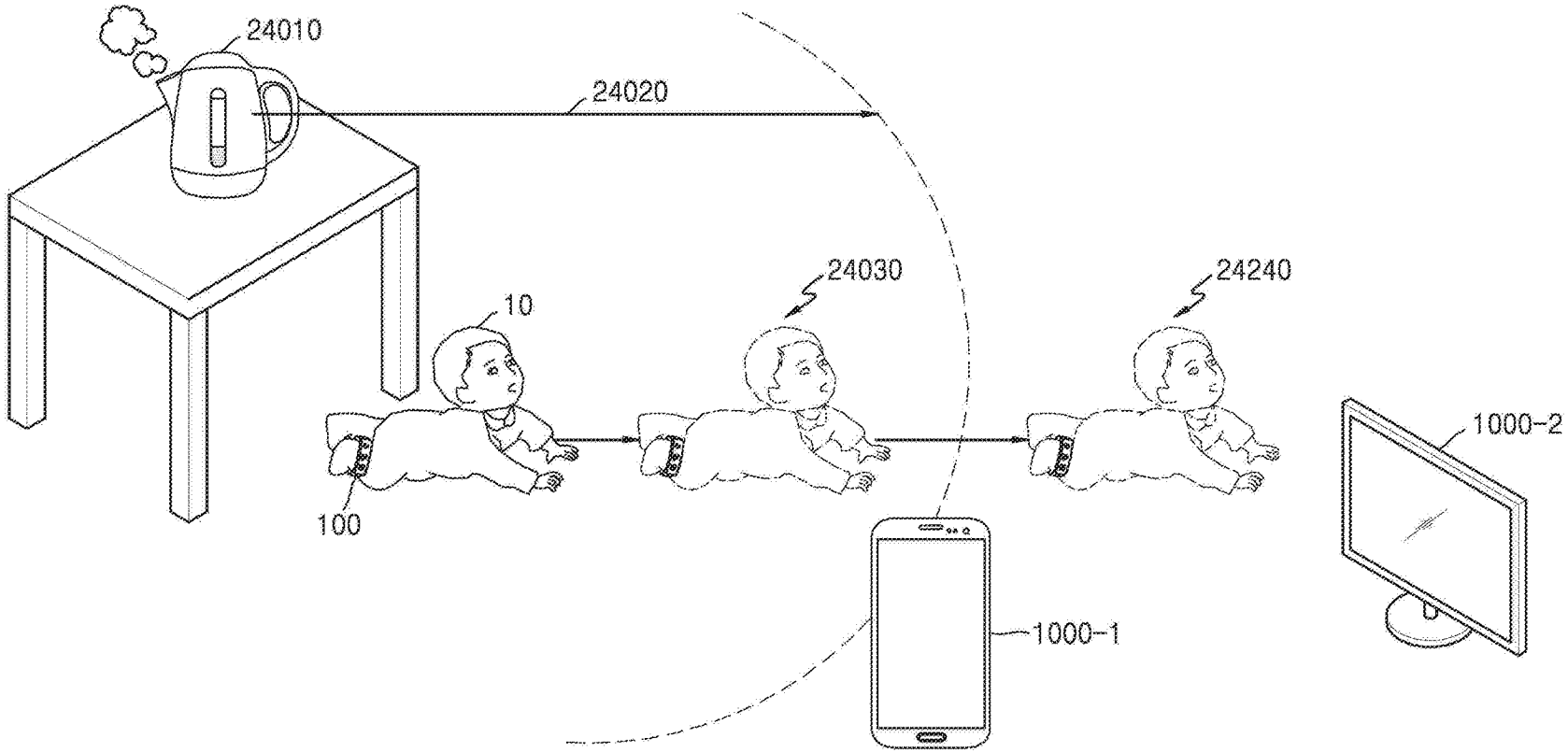
FIG. 24 is a diagram for describing an example of a system outputting feedback according to an embodiment of the present disclosure.

FIG. 24 is a diagram for describing an example of a system outputting feedback according to an embodiment of the present disclosure.

Referring to FIG. 24, an electric kettle 24010 is being used. Also, a distance between the wearer 10 wearing the wearable device 100 and the electric kettle 24010 is within a distance 24020 having a threshold value. The electric kettle 24010 may be broadcasting a short-distance wireless communication including information for identifying an electric kettle. Also, the electric kettle 24010 may be an IoT apparatus.

In order to induce the wearer 10 to move away from the electric kettle 24010, a smart phone 1000-1, that is, a first electronic apparatus, may output an alarm (feedback), such as a parent's voice or an image. Also, when the wearer 10 moves to a first location 24030, a TV 1000-2, that is, a second electronic apparatus, may output an alarm so as to induce the wearer 10 to move away from the electric kettle 24010. When the wearer 10 moves to a second location 24240, the TV 1000-2 may stop the outputting of the alarm.

According to an embodiment, an apparatus that is dangerous only while being used, such as the electric kettle 24010 or a fan, may stop being used when the wearable device 100 approaches the apparatus within the distance 24020.

Figure 25:
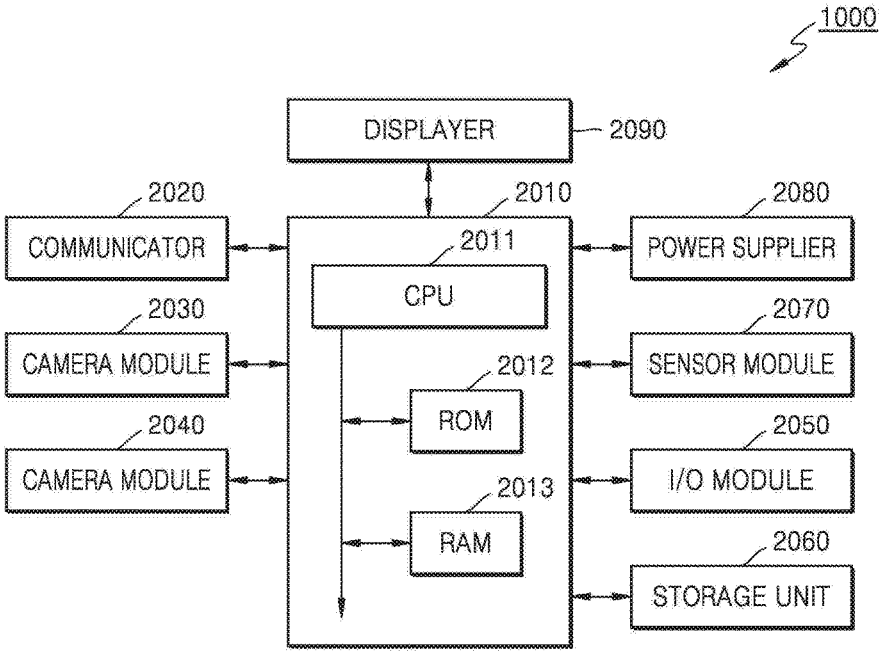
FIG. 25 is a block diagram of a structure of an electronic apparatus according to an embodiment of the present disclosure.

FIG. 25 is a block diagram of a structure of an electronic apparatus according to an embodiment of the present disclosure. The electric apparatus of FIG. 25 is only an example, and the electric apparatus may include more or less components than those shown in FIG. 25. The electronic apparatus may be a mobile phone, a smart phone, a tablet PC, a connected TV, a personal digital assistant (PDA), a PC, or a laptop, but is not limited thereto.

Referring to FIG. 25, the electronic apparatus 1000 may transmit and receive information to and from an external apparatus including the wearable device 100 by using a communicator 2020.

The electronic apparatus 1000 may include a controller 2010, the communicator 2020, a camera module 2030, a global positioning system (GPS) module 2040, an input/output (I/O) module 2050, a storage unit 2060, a sensor module 2070, a power supplier 2080, and a displayer 2090.

The communicator 2020 may include at least one of a mobile communication module, a sub-communication module, and a multimedia module. The sub-communication module may include at least one of a wireless local area network (LAN) module and a short-distance communication module. The multimedia module may include at least one of a broadcasting communication module, an audio reproduction module, and a video reproduction module. The camera module 2030 may include at least one camera. The I/O module 1050 may include at least one of a button, a microphone, a speaker, a vibration motor, a connector, and a keypad.

The controller 2010 may include a central processing unit (CPU) 2011, a read-only memory (ROM) 2012 in which a control program for controlling the electronic apparatus 1000 is stored, and a random access memory (RAM) 2013 in which a signal or data input from the outside of the electronic apparatus 1000 is stored or which is used as a storage area for operations performed in the electronic apparatus 1000. The CPU 2011 may include a plurality of processors, such as a single core, a dual core, a triple core, or a quad core. The CPU 2011, the ROM 2012, and the RAM 2013 may be connected to each other through an internal bus.

The controller 2010 may control the communicator 2020, the camera module 2030, the GPS module 2040, the I/O module 2050, the storage unit 2060, the sensor module 2070, the power supplier 2080, and the displayer 2090.

The mobile communication module may connect the electronic apparatus 1000 to an external apparatus via a mobile communication by using at least one antenna, under control of the controller 2010. The mobile communication module may transmit and receive a wireless signal for a voice call, an image call, short-message service (SMS) transmission, or multimedia service (MMS) transmission to and from a mobile phone corresponding to a phone number input to the displayer 2090, a smart phone, a tablet PC, or another apparatus.

The sub-communication module may include at least one of a wireless LAN module and a short-distance communication module. For example, the sub-communication module may include only a wireless LAN module, only a short-distance communication module, or both a wireless LAN module and a short-distance communication module.

The wireless LAN module may be connected to the Internet at a place where a wireless access point (AP) (not shown) is installed, according to control of the controller 2010. The wireless LAN module may support IEEE 802.11x that is wireless LAN standards of IEEE. The short-distance communication module may provide a wireless short-distance communication between the electronic apparatus 1000 and the wearable device 100, according to control of the controller 2010. A short-distance communication method may include Bluetooth, infrared data association (IrDA), or Zigbee.

The electronic apparatus 1000 may include at least one of the mobile communication module the wireless LAN module, and the short-distance communication module according to performance of the electronic apparatus 1000.

The multimedia module may include a broadcasting communication module, an audio reproduction module, or a video reproduction module. The broadcasting communication module may receive a broadcast signal and broadcast additional information through a broadcasting communication antenna, according to control of the controller 2010. The audio reproduction module may reproduce a digital audio file that is stored or received according to control of the controller 2010. The video reproduction module may reproduce a digital video file that is stored or received according to control of the controller 2010.

The camera module 2030 may include at least one camera capturing a still image or a moving image according to control of the controller 2010.

The GPS module 2040 may receive radio waves from a plurality of GPS satellites on the earth's orbit, and calculate a location of the electronic apparatus 1000 by using a time of arrival from the GPS satellites to the electronic apparatus 1000.

The I/O module 2050 may include at least one of a plurality of buttons, a microphone, a speaker, a vibration motor, a connector, and a keypad.

The buttons may be provided on a front surface, a side surface, or a rear surface of a housing of the electronic apparatus 1000, and may include at least one of a power/lock button, a volume button, a menu button, a home button, a back button, and a search button. The microphone may generate an electric signal upon receiving voice or sound, according to control of the controller 2010. The speaker may output sound corresponding to various signals to the outside the electronic apparatus 1000, according to control of the controller 2010. The vibration motor may convert an electric signal into mechanical vibration, according to control of the controller 2010. The connector may be used as an interface for connecting the electronic apparatus 1000 to an external apparatus or a power source. The keypad may be an interface receiving a key input for controlling the electronic apparatus 1000. Examples of the keypad include a physical keypad formed on the electronic apparatus 1000 and a virtual keypad displayed on the displayer 2090, when the displayer 2090 is a touch screen. The physical keypad may not be used according to performance or structure of the electronic apparatus 1000.

The sensor module 2070 may include at least one sensor detecting a state of the electronic apparatus 1000. For example, the sensor module 1070 may include a proximity sensor detecting proximity of the electronic apparatus 1000, an illuminance sensor detecting an amount of light, or a motion sensor detecting an operation of the electronic apparatus 1000 (e.g., rotation of the electronic apparatus 1000 or acceleration or vibration of the electronic apparatus 1000). The sensor of the sensor module 2070 may be added or removed according to performance of the electronic apparatus 1000.

The storage unit 2060 may store signal and data input and output according to operations of the communicator 2020, camera module 2030, GPS module 2040, I/O module 2050, sensor module 2070, and displayer 2090, according to control of the controller 2010. The storage unit 2060 may store a control program and application for controlling the electronic apparatus 1000 or controller 2010.

The term "storage unit" may include the storage unit 2060, the ROM 2012 or the RAM 2013 included in the controller 2010, or a memory card provided in the electronic apparatus 1000. The storage unit may be a nonvolatile memory, a volatile memory, a hard disk drive (HDD), or a solid state drive (SSD).

The power supplier 2080 may supply power to at least one battery (not shown) provided in the housing of the electronic apparatus 1000, according to control of the controller 2010. Also, the power supplier 2080 may provide power input from an external power source (not shown) to each component of the electronic apparatus 1000 through a wireless cable connected to the connector.

The displayer 2090 may output an image, such as a graphic user interface (GUI), corresponding to any one of various services. The displayer 2090 may include a touch screen according to performance of the electronic apparatus 1000.

Figure 26:
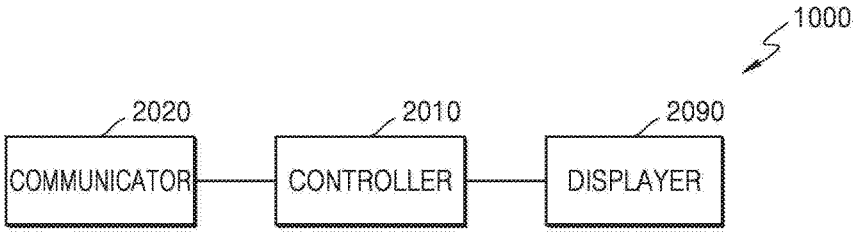
FIG. 26 is a block diagram of a simple structure of an electronic apparatus according to an embodiment of the present disclosure.

FIG. 26 is a block diagram of a simple structure of an electronic apparatus according to an embodiment of the present disclosure.

Referring to FIG. 26, the electronic apparatus 1000 according to an embodiment may include the controller 2010, the communicator 2020, and the displayer 2090. According to an embodiment, the communicator 2020 may receive sensor information (i.e., information obtained by using a sensor of the wearable device 100) from the wearable device 100.

The controller 2010 may generate related information based on the sensor information received through the communicator 2020. According to an embodiment, the controller 2010 may determine a state of the wearer of the wearable device 100. For example, the controller 2010 may determine that the wearer is sleeping when a pulse rate and a respiration rate included in the sensor information are within a pre-set range.

According to another embodiment, the controller 2010 may predict a point of time when the state of the wearer is to be changed, based on the sensor information. For example, the controller 2010 may determine that the wearer is sleeping based on the pulse rate and the respiration rate included in the sensor information, and predict when the wearer will wake up based on a history of the sensor information. A method of predicting a point of time when the state of the wearer is to be changed may be realized by pre-matching sleeping hours corresponding to the pulse rate and the respiration rate. However, an embodiment is not limited thereto. When the controller 2010 determines the point of time when the state of the wearer is to be changed, the displayer 2090 may output an alarm message at the determined point of time.

According to another embodiment, the controller 2010 may determine sleep guide information, such as a recommended number of sleeps and a recommended sleep posture, based on the sensor information. The controller 2010 may determine sleep information based on the sensor information. The sleep information may include information about how the wearer of the wearable device 100 sleeps, for example, at least one of whether the wearer is sleeping, a number of sleeps, sleeping hours, and a sleep posture. When it is determined that the wearer is not having a deep sleep based on the sleep information, the controller 2010 may determine the sleep guide information of the wearer. The sleep guide information may be information provided to the wearer such that the wearer gets a proper sleep. For example, the sleep guide information may include at least one of a recommended number of sleeps, recommended sleeping hours, a recommended sleep posture, and a sleeping environment creating method. The displayer 2090 may display the sleep information and the sleep guide information.

Figure 27:
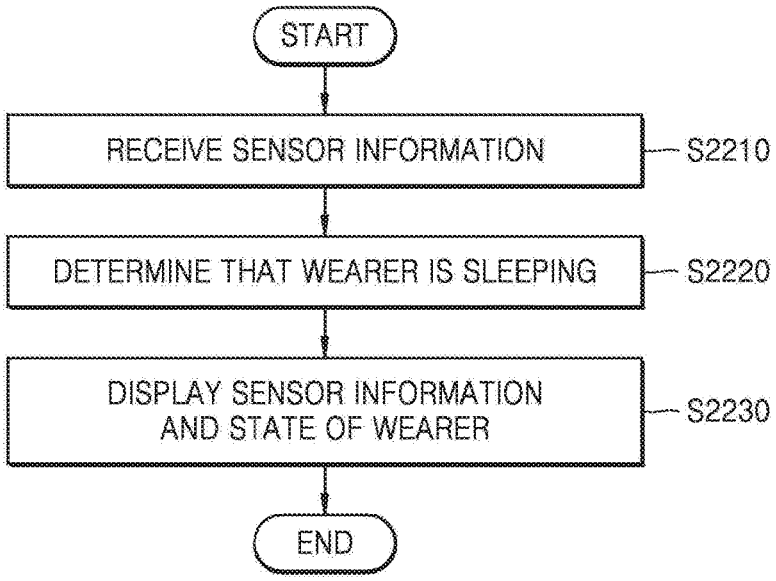
FIG. 27 is a flowchart illustrating operations of an electronic apparatus according to an embodiment of the present disclosure.

FIG. 27 is a flowchart illustrating operations of an electronic apparatus according to an embodiment of the present disclosure.

Referring to FIG. 27, in operation S2210, the electronic apparatus 1000 may receive sensor information from the wearable device 100.

The electronic apparatus 1000 may generate related information based on the sensor information. According to an embodiment, the wearable device 100 may determine a state of the wearer of the wearable device 100. For example, when pulse rate and a respiration rate included in the sensor information are within a pre-set range, the electronic apparatus 1000 may determine that the wearer is sleeping, in operation S2220. In operation S2230, the electronic apparatus 1000 may display the sensor information and the state of the wearer.

According to another embodiment, the electronic apparatus 1000 may predict a point of time when the state of the wearer is to be changed based on the sensor information. For example, the electronic apparatus 1000 may determine whether the wearer is sleeping based on the pulse rate and the respiration rate included in the sensor information, and predict when the wearer may wake up based on a history of the sensor information. A method of predicting a point of time when the state of the wearer is to be changed may be realized by pre-matching sleeping hours corresponding to the pulse rate and the respiration rate. However, an embodiment is not limited thereto. When the point of time when the state of the wearer is to be changed is determined, the electric apparatus 1000 may output an alarm message at the determined point of time.

Figure 28:
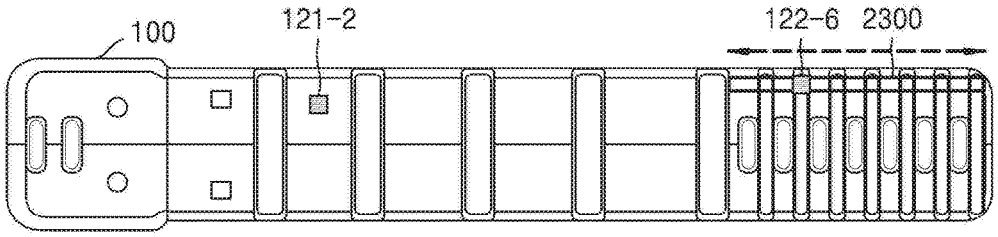
FIG. 28 is a plan view of a structure of a wearable device in which a location of an optical receiver is movable according to an embodiment of the present disclosure.

FIG. 28 is a diagram of an appearance of a wearable device in which a location of an optical receiver is movable according to an embodiment of the present disclosure.

Referring to FIG. 28, the wearable device 100 according to an embodiment may include an optical receiver 122-6 that is movable in order to receive light emitted from the emitter 121-2. For example, the optical receiver 122-6 may move along a guideline 2300 formed on an outer cover of the wearable device 100, but an embodiment is not limited thereto.

The wearable device 100 includes the optical receiver 122-6 that is movable, but alternatively, the emitter 121-2 may be movable. Alternatively, the emitter 121-2 and the optical receiver 122-6 may each be movable.

Figure 29:
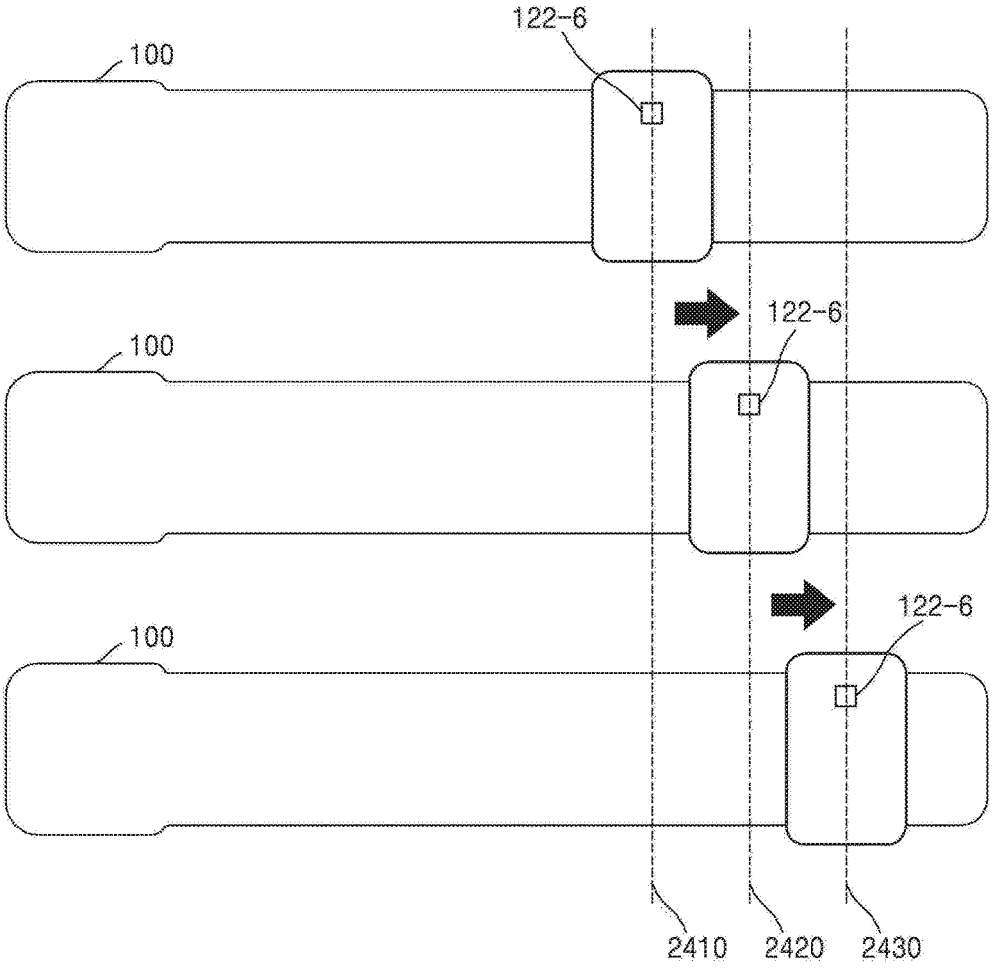
FIG. 29 is a conceptual diagram of a wearable device in which a location of an optical receiver moves gradationally according to an embodiment of the present disclosure.

FIG. 29 is a conceptual diagram of a wearable device in which the location of an optical receiver moves gradationally according to an embodiment of the present disclosure.

Referring to FIG. 29, when the wearable device 100 includes the optical receiver 122-6 that is movable, the wearable device 100 may be realized such that the location of the optical receiver 122-6 is gradationally movable.

For example, the wearable device 100 may be realized such that the optical receiver 122-6 is fixed at a first location 2410, a second location 2420, or a third location 2430 with respect to an outside of the wearable device 100, by using a latch or the like.

Figure 30A:
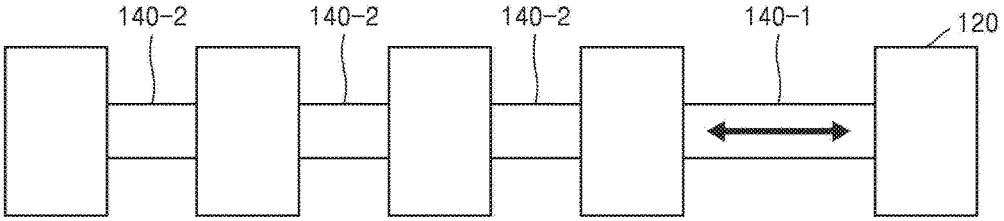
FIGS. 30A and 30B are conceptual diagrams of a structure of a circuit included inside an outer cover of a wearable device in which a location of a sensor unit is movable according to various embodiments of the present disclosure.
Figure 30B:
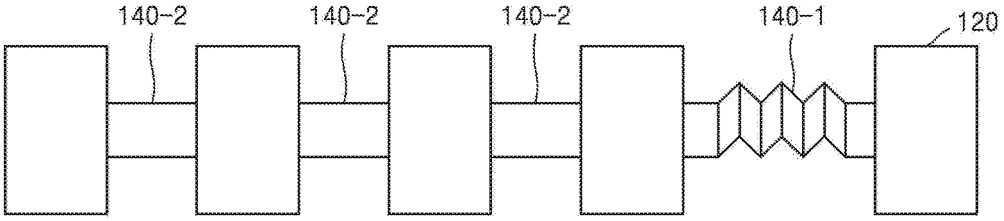

FIGS. 30A and 30B are conceptual diagrams of a structure of a circuit included inside an outer cover of a wearable device in which a location of a sensor unit is movable according to various embodiments of the present disclosure.

Referring to FIG. 30A, the connector 140 of the wearable device 100 may include a connector 140-1 that is stretchable and connects the sensor unit 120 (e.g., including an optical sensor) and another component, and a connector 140-2 that is not stretchable. For example, the connector 140-1 that connects the sensor unit 120 and the other component may be configured as a stretchable PCB.

Referring to FIG. 30B, as another example, the connector 140-1 that connects the sensor unit 120 and the other component may be configured as a FPCB having wrinkles.

When the connector 140-1 is stretchable, durability of the connector 140-1 may be low compared to the connector 140-2 that is not stretchable, due to a flexible structure of the connector 140-1, and thus durability of the circuit included in the wearable device 100 may be increased by forming only a part of the connector 140-1 to be stretchable. Also, by using the connector 140-1 that is stretchable, information to be detected through the sensor unit 120 may be detected at an accurate location.

Figure 31:
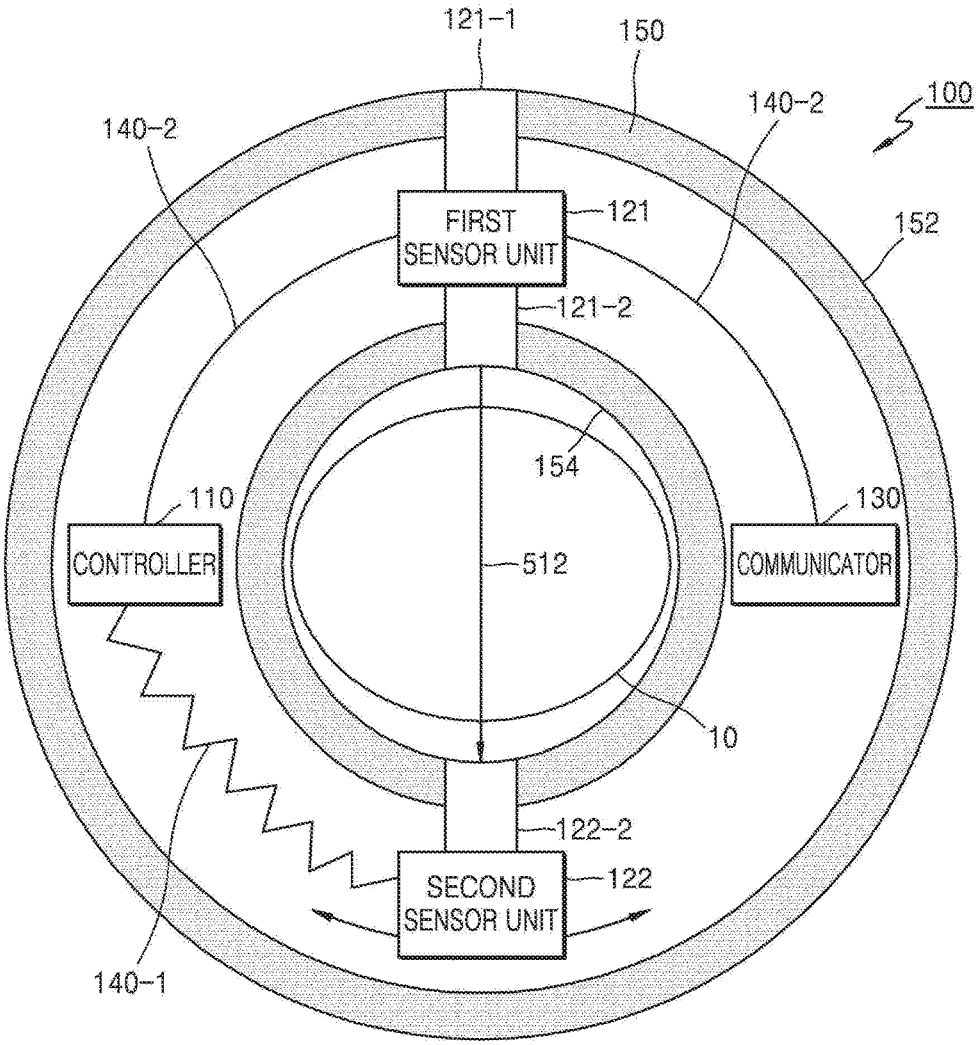
FIG. 31 is a cross-sectional view of a structure of a wearable device according to an embodiment of the present disclosure.

FIG. 31 is a cross-sectional view of a structure of a wearable device, according to an embodiment of the present disclosure.

Referring to FIG. 31, the outer cover 150 has a ring structure, and only the connector 140-1 from among the connector 140 is stretchable. The connector 140-1 connecting the second sensor unit 122 and the controller 110 may have a stretchable structure as the connector 140-1 of FIG. 30A or 30B. Also, the second sensor unit 122 may be movable within the outer cover 150. By moving the location of the second sensor unit 122, the location of the optical receiver 122-2 for receiving the light 512 emitted from the emitter 121-2 of the first sensor unit 121 may be moved.

Also, for durability of a circuit, the connector 140-2 connecting the controller 110 and the first sensor unit 121 and the connector 140-2 connecting the first sensor unit 121 and the communicator 130 may be configured of a fixed PCB or a flexible PCB.

Arrangements of components shown in FIG. 31 are only an example, and locations and arrangements of the components may be changed according to various embodiments.

Figure 32:
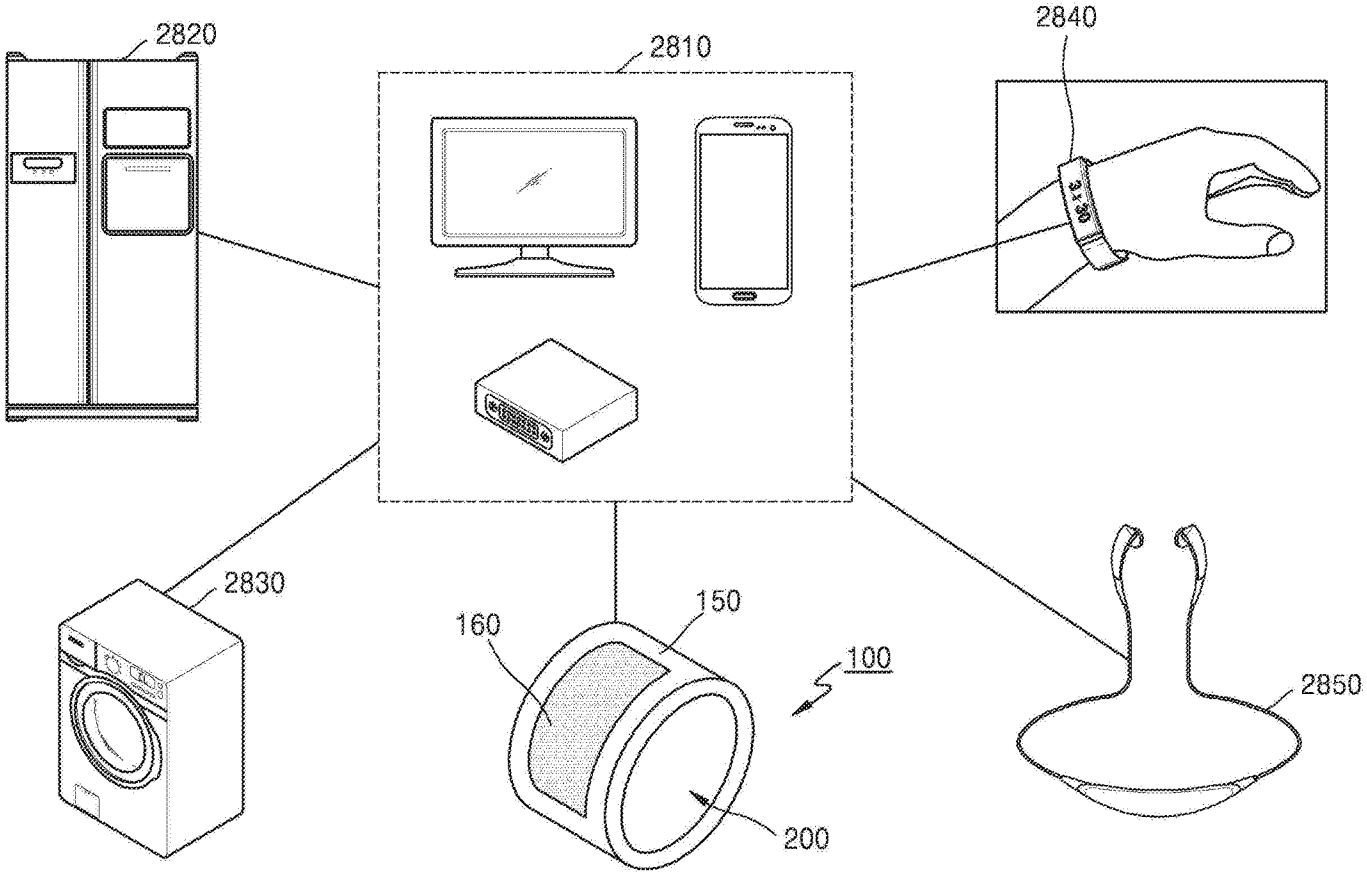
FIG. 32 is a diagram for describing a method of outputting alarm information according to an embodiment of the present disclosure.

FIG. 32 is a diagram for describing a method of outputting alarm information according to an embodiment of the present disclosure. The method of FIG. 32 is only an example, and thus is not limited thereto.

Referring to FIG. 32, when sensor information obtained by the wearable device 100 is not within a normal range, alarm information may be output. The alarm information may be output in any one of various forms, according to various embodiments. According to an embodiment, the wearable device 100 may include a display 160 that is externally exposed on the outer cover 150. In this case, the wearable device 100 may display the alarm information through the display 160.

Alternatively, the wearable device 100 may transmit the alarm information to an electronic apparatus 2810. A type of the electronic apparatus 2810 may vary. For example, the electronic apparatus 2810 may be a connected TV, a smart phone, a tablet PC, or an IoT hub, which is capable of receiving the alarm information from the wearable device 100, but is not limited thereto.

Upon receiving the alarm information, the electronic apparatus 2810 may directly output the alarm information or transmit the alarm information to another device. The electronic apparatus 2810 may select a suitable device and transmit the alarm information to the suitable device. For example, the electronic apparatus 2810 may search for a device currently used, and transmit the alarm information to a found device. The alarm information may be output in a suitable form according to performance of a device that received the alarm information. For example, when the alarm information is transmitted to a refrigerator 2820 or a washing machine 2830, which includes a display, the alarm information may be displayed on the display of the refrigerator 2820 or the washing machine 2830. As another example, when the alarm information is transmitted to a wearable device 2840 worn by a wearer other than the wearer of the wearable device 100, the wearable device 2840 may output the alarm information by using at least one of vibration, sound, and a screen. As another example, when the alarm information is transmitted to a communicable earphone 2850, the alarm information may be output by using vibration or sound.

According to an embodiment, a device outputting the alarm information may vary according to a type of the alarm information. For example, when there is a device communicably connected to the wearable device 100, alarm information indicating that the wearer of the wearable device 100 woke up may be transmitted only to the communicably connected device. Alternatively, when there is no device communicably connected to the wearable device 100, the alarm information indicating that the wearer of the wearable device 100 woke up may be transmitted to a device being used by the wearer or to a device recently used by the wearer. On the other hand, alarm information indicating an emergency, for example, abnormal oxygen saturation, abnormal respiration, or abnormal heart rate, may be broadcasted to all devices around the wearable device 100.

FIG. 33 is a table for describing standards for determining whether sensor information is within a normal range according to an embodiment of the present disclosure.

Referring to FIG. 33, the wearable device 100 or the electronic apparatus 1000 may determine whether sensor information is within a normal range based on the table shown in FIG. 33. However, an embodiment is not limited thereto, and standards for determining whether sensor information is within a normal range may vary according to various embodiments. For example, referring to FIG. 33, it may be determined that the sensor information is within the normal range when oxygen saturation included in the sensor information is equal to or higher than 95%. However, it may be determined that the sensor information is not within the normal range when the oxygen saturation included in the sensor information is lower than 95%. As another example, it may be determined that the sensor information is within the normal range when a heart rate included in the sensor information is between 120 to 140 times. As another example, it may be determined that the sensor information is within the normal range when a body temperature included in the sensor information is between 36.8 to 37.3° C.

According to an embodiment, the wearable device 100 or the electronic apparatus 1000 may recommend suitable sleep patterns. In other words, sleep information may be determined based on sensor information obtained through a sensor of the wearable device 100. Also, the wearable device 100 may provide sleep guide information based on the sleep information.

FIG. 34 is a table for describing examples of suitable sleep patterns according to an embodiment of the present disclosure.

Referring to FIG. 34, according to an embodiment, the wearable device 100 or the electronic apparatus 1000 may determine night sleeping hours, day sleeping hours, a number of daytime naps, and total number of sleeping hours of the wearer of the wearable device 100, based on the sensor information. When the night sleeping hours, the day sleeping hours, the number of daytime naps, and the total sleeping hours do not match the suitable sleep patterns shown in FIG. 34, the wearable device 100 or the electronic apparatus 1000 may output alarm information recommending the suitable sleep patterns. For example, when the wearer of the wearable device 100 is 9 month old and the number of daytime naps is 4 times. The wearable device 100 or the electronic apparatus 1000 may output alarm information that the wearer needs to reduce the number of day sleeps.

Figure 35:
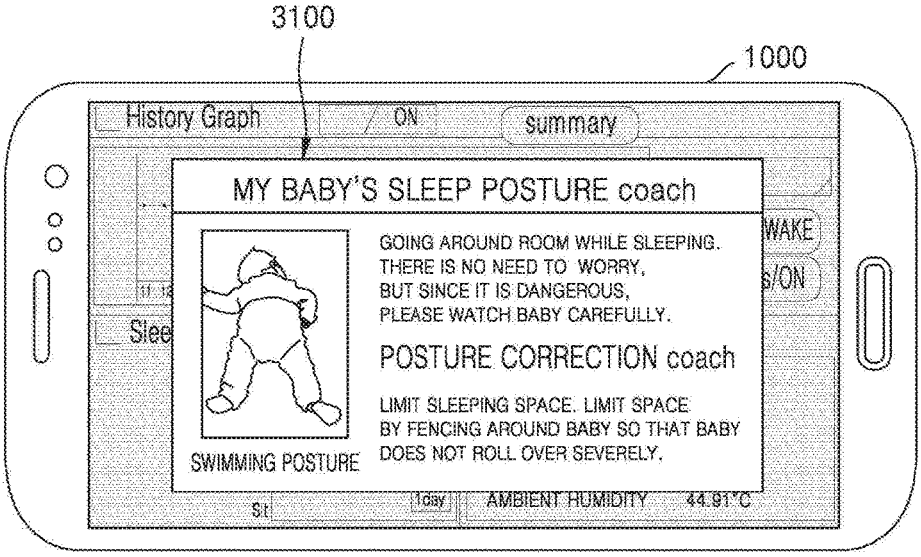
FIG. 35 is a diagram for describing a method of providing information about a sleep posture according to an embodiment of the present disclosure.

FIG. 35 is a diagram for describing a method of providing information about a sleep posture according to an embodiment of the present disclosure.

Referring to FIG. 35, the wearable device 100 or the electronic apparatus 1000 may determine a sleep posture of the wearer of the wearable device 100 based on sensor information obtained by the wearable device 100. For example, the sleep posture of the wearer may be determined based on sensor information obtained by an acceleration sensor or a gyro sensor detecting movement of the wearable device 100. The wearable device or the electronic apparatus 1000 may output at least one of information about the sleep posture and information about posture correction 3100. For example, the wearable device 100 or the electronic apparatus 1000 may display, through a display of the wearable device 100 or the electronic apparatus 1000, a message related to the sleep posture of the wearer as shown in FIG. 35.

FIG. 36 illustrates feedback output according to various embodiments of the present disclosure.

Referring to FIG. 36, suitable information according to a state of a wearer of the wearable device 100 may be output through the electronic apparatus 1000, as feedback regarding sensor information. According to an embodiment, the suitable information may be output based on the state of the wearer and profile information related to the wearer, which are determined according to the sensor information. The profile information may be transmitted from the wearable device 100 to the electronic apparatus 1000, or may be stored in the electronic apparatus 1000. Alternatively, the profile information may be received from an external server, but an embodiment is not limited thereto.

When respiration and a heartbeat of the wearer are not detected, a link 3600 for calling a rescue team may be displayed through the electronic apparatus 1000. Also, when the wearer is an infant of 12-months or less, information 3610-1 for performing cardiopulmonary resuscitation (CPR) on the infant may be displayed through the electronic apparatus 1000. Alternatively, when the wearer is a child over 12-months, information 3610-2 for performing CPR on the child may be displayed through the electronic apparatus 1000.

As another example, when a body temperature of the wearer, which is included in the sensor information, is higher than a threshold value, text such as "Please put on lighter clothes or reduce fever by cooling the forehead". As another example, when oxygen saturation of the wearer, which is included in the sensor information, is lower than a threshold value, text such as "Oxygen saturation may reduce when lung pressure temporarily increases while crying if lungs are weak. Please comfort baby and monitor oxygen saturation. If oxygen saturation still remains low even after baby is calm, please see doctor". By outputting the text, a user of the electronic apparatus 1000 may determine steps to be taken based on a state of the wearer of the wearable device 100 without having to perform a separate search.

According to an embodiment, information provided as feedback of sensor information may be stored in the electronic apparatus 1000. According to another embodiment, information provided as feedback of sensor information may be downloaded to the electronic apparatus 1000 from an external server, such as a cloud server. As another example, information provided as feedback of sensor information may be searched from an online community. The online community is a virtual information sharing space accessible by using an application related to the wearable device 100, the application installed in the electronic apparatus 1000. Alternatively, the online community may include an online space pre-associated with the application installed in the electronic apparatus 1000, but an embodiment is not limited thereto. The electronic apparatus 1000 may output, as the feedback of the sensor information, information searched from the online community based on a state of the wearer and profile information of the wearer (e.g., a gender, a height, a weight, and an age).

An embodiment may also be realized in a form of a computer-readable recording medium, such as a program module executed by a computer. A computer-readable recording medium may be an arbitrary available medium accessible by a computer, and examples thereof include all volatile media, such as a RAM, and non-volatile media, such as a ROM, and separable and non-separable media. Further, examples of the computer-readable recording medium may include a computer storage medium and a communication medium. Examples of the computer storage medium include all volatile and non-volatile media and separable and non-separable media, which have been implemented by an arbitrary method or technology, for storing information such as computer-readable commands, data structures, program modules, and other data. The communication medium typically include a computer-readable command, a data structure, a program module, other data of a modulated data signal, or another transmission mechanism, and an example thereof includes an arbitrary information transmission medium. For example, the computer storage medium may be ROM, RAM, a flash memory, compact disc (CD), digital versatile disc (DVD), a magnetic disk, or a magnetic tape.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A wearable device comprising:

at least two sensors configured to detect biometric information of a wearer of the wearable device;

a connector electrically connecting the at least two sensors to each other and having elasticity;

a communicator configured to transmit the biometric information to an external apparatus; and at least one processor configured to control the at least two sensors and the communicator, wherein the at least two sensors are imbedded in a ring structure or a band structure comprising a fastening portion at two ends, wherein each of the at least two sensors comprises:

an emitter configured to emit light, and an optical receiver configured to receive the light emitted from the emitter, wherein the connector electrically connects at least two of the emitter, the optical receiver, or the at least one processor, and wherein a location of at least one of the emitter, the optical receiver, or the at least one processor changes according to a length of the connector wherein the communicator is further configured to receive a short-distance wireless communication signal from an apparatus broadcasting identification (ID) information, and wherein the at least one processor is further configured to control the communicator to transmit alarm information to the external apparatus based on a strength of the short-distance wireless communication signal.

2. The wearable device of claim 1, wherein a distance between the at least two sensors changes according to a length of the connector.

3. The wearable device of claim 1, wherein the optical receiver comprises a plurality of photodiodes (PDs) configured to receive an optical signal and convert the optical signal into an electric signal.

4. The wearable device of claim 3, wherein the at least one processor is further configured to select one of the plurality of PDs based on the electric signal, and wherein the biometric information is obtained by using the selected PD.

5. The wearable device of claim 1, wherein the at least one processor is further configured to:

determine whether the biometric information is within a normal range, and control the communicator to transmit, when it is determined that the biometric information is not within the normal range, alarm information to the external apparatus.

6. The wearable device of claim 5, wherein the alarm information comprises at least one of information indicating that a state of the wearer is abnormal or information indicating that a wearing state of the wearable device is poor.

7. The wearable device of claim 6, wherein the communicator is further configured to transmit the alarm information to an apparatus matched to the wearable device or broadcast the alarm information.

8. The wearable device of claim 1, wherein at least one of the emitter or the optical receiver is moveable gradationally such that a distance between the emitter and the optical receiver changes.

9. The wearable device of claim 1, wherein the at least one processor is further configured to:

determine a distance between the wearable device and the apparatus broadcasting the ID information based on the strength of the short-distance wireless communication signal, and output, when the determined distance is lower than or equal to a threshold value, feedback comprising at least one of a sound, an image, or a vibration.

10. The wearable device of claim 9, wherein the at least one processor is further configured to control the communicator to request a first electronic apparatus to output the feedback when the determined distance is lower than or equal to the threshold value.

11. The wearable device of claim 10, wherein the at least one processor is further configured to:

re-determine the distance between the wearable device and the apparatus broadcasting the ID information after the output of the feedback is requested, and request, when the re-determined distance is not increased compared to the determined distance, the first electronic apparatus to increase a strength of outputting the feedback.

12. The wearable device of claim 1, wherein the connector comprises at least one of a wrinkled flexible printed circuit board (PCB) or a stretchable PCB.

13. The wearable device of claim 1, further comprising a stretchable outer cover, wherein a material of the stretchable outer cover is any one of rubber, urethane, or silicon.

* * * * *